US011801689B2

(12) United States Patent
Ellis et al.

(10) Patent No.: US 11,801,689 B2
(45) Date of Patent: Oct. 31, 2023

(54) TAPE DRIVE AND METHOD

(71) Applicant: VIDEOJET TECHNOLOGIES INC., Wood Dale, IL (US)

(72) Inventors: Jeremy Ellis, Nottingham (GB); Philip Hart, Nottingham (GB)

( * ) Notice: Subject to any disclaimer, the term of this patent is extended or adjusted under 35 U.S.C. 154(b) by 861 days.

(21) Appl. No.: 16/624,613

(22) PCT Filed: Jun. 27, 2018

(86) PCT No.: PCT/GB2018/051795
§ 371 (c)(1),
(2) Date: Dec. 19, 2019

(87) PCT Pub. No.: WO2019/002856
PCT Pub. Date: Jan. 3, 2019

(65) Prior Publication Data

US 2020/0114641 A1 Apr. 16, 2020

(30) Foreign Application Priority Data

Jun. 28, 2017 (GB) ..... 1710350
Jun. 28, 2017 (GB) ..... 1710351

(51) Int. Cl.
*B41J 2/325* (2006.01)
*B41F 16/00* (2006.01)
(Continued)

(52) U.S. Cl.
CPC ..... *B41J 2/325* (2013.01); *B41F 16/0026* (2013.01); *B41J 2/36* (2013.01); *B41J 17/07* (2013.01);
(Continued)

(58) Field of Classification Search
CPC ..... B41J 2/325; B41J 2/36; B41J 17/07; B41J 17/10; B41J 33/16; B41J 33/36; B41J 35/36; B41F 16/0026
See application file for complete search history.

(56) References Cited

U.S. PATENT DOCUMENTS 5,647,679 A * 7/1997 Green ..... B41J 17/04 400/232
5,769,549 A 6/1998 Kouzai et al.
(Continued)

FOREIGN PATENT DOCUMENTS

CN 1037870 A 12/1989
CN 1473110 A 2/2004
(Continued)

OTHER PUBLICATIONS

PCT/GB2018/051795 International Search Report and Written Opinion, dated Dec. 3, 2018, 12 pages.
(Continued)

*Primary Examiner* — Jill E Culler
(74) *Attorney, Agent, or Firm* — Wolter Van Dyke Davis, PLLC; Robert L. Wolter

(57) ABSTRACT

A method of operating a transfer printer configured to transfer ink from a printer ribbon to a substrate which is transported along a predetermined substrate path adjacent to the printer. The printer comprises a tape drive comprising two tape drive motors, two tape spool supports on which said spools of ribbon may be mounted, each spool being drivable by a respective one of said motors. The printer further comprises a printhead being displaceable towards and away from the predetermined substrate path and being arranged to, during printing, contact one side of the ribbon to press an opposite side of the ribbon into contact with a substrate on the predetermined substrate path, and a printing surface. The printer further comprises a controller config-
(Continued)

ured to control the tape drive to transport ribbon between the first and second ribbon spools. The method comprises controlling the tape drive to perform a ribbon movement in which ribbon is transported between first and second ribbon spools along a ribbon path, the ribbon path having a first length during a first part of said ribbon movement, and a second length during a second part of said ribbon movement, a transition from the first length to the second length being caused by a displacement of the printhead with respect to the printing surface, wherein control of at least one of the tape drive motors is based upon data indicative of the first and second lengths.

17 Claims, 7 Drawing Sheets

(51) Int. Cl.

| | |
|---|---|
| ***B41J 2/36*** | (2006.01) |
| ***B41J 35/36*** | (2006.01) |
| ***B41J 33/16*** | (2006.01) |
| ***B41J 33/36*** | (2006.01) |
| ***B41J 17/07*** | (2006.01) |
| ***B41J 17/10*** | (2006.01) |

(52) U.S. Cl.
CPC ..... *B41J 17/10* (2013.01); *B41J 33/16* (2013.01); *B41J 33/36* (2013.01); *B41J 35/36* (2013.01)

(56) References Cited

U.S. PATENT DOCUMENTS

| | | | | |
|---|---|---|---|---|
| 7,150,572 | B2 * | 12/2006 | McNestry | B41J 33/36 400/232 |
| 9,327,498 | B1 | 5/2016 | Mantell | |
| 11,260,650 | B2 * | 3/2022 | Ellis | B41J 33/16 |
| 2005/0140768 | A1 | 6/2005 | Aspenns et al. | |
| 2006/0007295 | A1 | 1/2006 | Ueda | |
| 2010/0172682 | A1 * | 7/2010 | Hart | B41J 33/34 400/234 |
| 2016/0165110 | A1 | 6/2016 | Weng et al. | |

FOREIGN PATENT DOCUMENTS

| | | | |
|---|---|---|---|
| CN | 1657306 | A | 8/2005 |
| CN | 101678687 | A | 3/2010 |
| CN | 103917374 | A | 7/2014 |
| CN | 103930280 | A | 7/2014 |
| CN | 105093825 | A | 11/2015 |
| CN | 105324247 | A | 2/2016 |
| EP | 0510768 | A2 | 10/1992 |
| EP | 0546303 | A2 | 6/1993 |
| GB | 2404896 | A | 2/2005 |
| GB | 2449676 | A | 12/2008 |
| GB | 2542549 | A | 3/2017 |
| JP | S6019542 | A | 1/1985 |
| JP | S6064878 | A | 4/1985 |
| JP | S60131286 | A | 7/1985 |
| JP | S61123567 | A | 6/1986 |
| JP | H02141277 | A | 5/1990 |
| JP | H02303882 | A | 12/1990 |
| JP | H07214849 | A | 8/1995 |
| JP | H07251517 | A | 10/1995 |
| JP | 2001249796 | A | 9/2001 |
| JP | 2005119065 | A | 5/2005 |
| JP | 2008272971 | A | 11/2008 |
| JP | 2012126116 | A | 7/2012 |
| JP | 2016176861 | A | 10/2016 |
| WO | 2003029013 | A | 10/2003 |
| WO | 2008107646 | A | 9/2008 |
| WO | 2013025746 | A | 2/2013 |
| WO | 2013025749 | A1 | 2/2013 |
| WO | 2014011654 | A1 | 7/2013 |
| WO | 2016067051 | A | 10/2015 |
| WO | 2016067052 | A1 | 5/2016 |

OTHER PUBLICATIONS

Search Report for GB1710351.6, dated Feb. 20, 2018, 5 pages.
Search Report for GB1710350.8, dated Feb. 20, 2018, 5 pages.

* cited by examiner

TAPE DRIVE AND METHOD

The present invention relates to a tape drive and method of its operation. More particularly, but not exclusively, the invention relates to apparatus and methods for controlling the operation of a tape drive in a thermal transfer printer to control the movement of ribbon, for monitoring and controlling movement of a printhead relative to a printing surface against which printing is to take place, and for monitoring quality of printed images by an image capture system.

Thermal transfer printers use an ink carrying ribbon. In a printing operation, ink carried on the ribbon is transferred to a substrate which is to be printed. To effect the transfer of ink, a print head is brought into contact with the ribbon, and the ribbon is brought into contact with the substrate. The print head contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

It is known that various factors affect print quality. Accurate control of the ribbon during movements by a tape drive, including during periods of acceleration and deceleration, and knowledge of the position of the ribbon during such movements is important in ensuring that printing is carried out in a controlled and predictable way. However, in use, there may be discrepancies between the actual position of portions of ribbon and the expected position of those portions or ribbon. Such discrepancies may be caused by a number of reasons, such as, for example incorrect ribbon tension, or incorrect movements of the ribbon by the tape drive.

Moreover, where printing is carried out incorrectly, it may be possible for incorrectly printed articles to remain undetected. By capturing images of regions of ribbon used for printing, or substrates on which printing has been carried out, it is possible to monitor the quality of printing. However, such image capture may be unreliable if ribbon control is not performed accurately. Similarly, defects in the image capture system may provide false indications of incorrect printing, or may wrongly allow incorrectly printed substrates to pass undetected.

It is an object of some embodiments of the present invention to provide a novel method, tape drive and printer which obviates or mitigates at least some of the disadvantages set out above or inherent in existing printers and tape drives.

According to a first aspect of the invention there is provided method of operating a transfer printer configured to transfer ink from a printer ribbon to a substrate which is transported along a predetermined substrate path adjacent to the printer. The printer comprises a tape drive comprising two tape drive motors, two tape spool supports on which said spools of ribbon may be mounted, each spool being drivable by a respective one of said motors. The printer further comprises a printhead being displaceable towards and away from the predetermined substrate path and being arranged to, during printing, contact one side of the ribbon to press an opposite side of the ribbon into contact with a substrate on the predetermined substrate path, and a printing surface. The printer further comprises a controller configured to control the tape drive to transport ribbon between the first and second ribbon spools. The method comprises controlling the tape drive to perform a ribbon movement in which ribbon is transported between first and second ribbon spools along a ribbon path, the ribbon path having a first length during a first part of said ribbon movement, and a second length during a second part of said ribbon movement. A transition from the first length to the second length is caused by a displacement of the printhead with respect to the printing surface. Control of at least one of the tape drive motors is based upon data indicative of the first and second lengths.

In this way, the tape drive motors can be controlled so as to accommodate disturbances to the ribbon by the printhead during movement of the ribbon between the spools. Such control of the motors allows for ribbon to be more accurately positioned during ribbon transport operations, and for ribbon tension to be maintained more closely to an optimum level during ribbon transport operations (rather than just being regulated at periodic intervals).

The transition from the first length to the second length may be caused by a displacement of the printhead towards and away from the printing surface.

Control of the at least one of the tape drive motors may be based upon data indicative of a position of the printhead.

Data indicative of the first and second lengths may comprise a length in millimetres or a value in any other convenient units. The data indicative of the first and second lengths may comprise data indicative of a difference between the first and second lengths (e.g. a path length change). The data indicative of the first and second lengths may comprise data indicative of a position of the printhead during each of the first and second parts of said ribbon movement.

The at least one tape drive motor may be a position controlled motor. Each of the tape drive motors may be a position controlled motor. One or both of the tape drive motors may be stepper motors. Where one or both of the tape drive motors are stepper motors, the tape drive motors may be controlled by applying a series of step commands to the motors, causing the motor shaft to move by a predetermined amount. By controlling the time at which the step commands are applied to the motor, the speed of rotation can be controlled.

The at least one tape drive motor may be controlled based upon data indicative of a change in the length of the ribbon path, said data indicative of a change in the length of the ribbon path being determined based upon said data indicative of the position of the printhead.

It will be understood that movement of the printhead causes deflection of the ribbon (and thus the transition from the first to the second length). Thus, the position of the printhead may be used to generate data indicative of a change in the length of the ribbon path, which can in turn be used to control the at least one motor. That is, the motor can be controlled either directly or indirectly based upon the data indicative of the position of the printhead.

When the printhead is displaced so as to cause the ribbon to come into contact with the substrate, the controller may be configured to control the at least one tape drive motor to increase the amount of ribbon extending between the spools.

When the printhead is displaced so as to cause the ribbon to come out of contact with the substrate, the controller may be configured to control the at least one tape drive motor to reduce the amount of ribbon extending between the spools.

In this way, any increase or decrease in tension in the ribbon extended between the spools caused by the printhead being displaced can be compensated for by adjusting the speed or position of the motor. For example, when the printhead is displaced into contact with the substrate during a ribbon transport operation (e.g. during continuous printing), the speed of one or both of the motors can be adjusted to provide an increase in the amount of ribbon extending between the spools. On the other hand, when the printhead is displaced out of contact with the substrate during a ribbon transport operation, the speed of one or both of the motors can be adjusted to provide a decrease or reduction in the amount of ribbon extending between the spools.

The amount of ribbon extending between the spools may be increased or decreased at the same time as the printhead is displaced into or out of contact with the substrate. Alternatively, the amount of ribbon extending between the spools may be adjusted momentarily before or after the printhead is displaced with respect to the substrate.

Moreover, it will be understood that the printhead position may change gradually, and that the ribbon may thus be gradually deflected. Any correction to the amount of ribbon extending between the spools may also be gradually applied by the one or more motors.

Indeed, where the ribbon amount is corrected by adjusting the speed of one of both of the motors, this effect will occur gradually (i.e. the increase or decrease in ribbon length being a cumulative effect over a period during which the tape drive motor speed is adjusted with respect to an un-adjusted speed.

The increase or reduction in the amount of ribbon extending between the spools may be determined based upon the data indicative of a position of the printhead.

The printer may further comprise a printhead drive apparatus. The printhead drive apparatus may be configured to drive the printhead towards and away from the predetermined substrate path. The method may comprise controlling the printhead drive apparatus to drive the printhead towards and away from the predetermined substrate path, and generating the data indicative of a change in the length of the ribbon path based upon a property of the printhead drive apparatus.

The printer may comprise a sensor configured to generate a signal indicative of a property of the printhead drive apparatus. By use of the sensor associated with the printhead drive apparatus, it is possible to provide accurate positional information regarding the actual printhead position, thereby allowing the printhead to be accurately controlled.

The printhead drive apparatus may comprise a printhead motor. The printhead motor may be a stepper motor having an output shaft coupled to the printhead, the stepper motor being arranged to vary the position of the printhead relative to the printing surface. The stepper motor may further be arranged to control the pressure exerted by the printhead on the printing surface.

The printer may further comprise a sensor configured to generate a signal indicative of an angular position of the output shaft of the printhead motor.

The printer may further comprise a controller arranged to generate control signals for the stepper motor so as to cause a predetermined torque to be generated by the stepper motor; said control signals being at least partially based upon an output of said sensor.

By use of the sensor (e.g. a rotary encoder) associated with the output shaft of the stepper motor, it is possible to provide accurate positional information regarding the actual rotor position, thereby allowing the printhead motor to be accurately controlled.

The data indicative of the position of the printhead may be based upon the generated signal indicative of the angular position of the output shaft of the printhead motor.

When the printhead is not in contact with the printing surface (or just at the point of making contact with the printing surface), the sensor output may be used to generate data indicative of the actual printhead position. During such movements of the printhead, the printhead position will generally have a predetermined relationship with the sensor output.

The data indicative of the position of the printhead may be further based upon further data indicative of a printhead position.

When the printhead is in contact with the printing surface and pressing against the printing surface (e.g. with the printing force), data indicative of an expected contact position may be used to generate data indicative of the actual printhead position in preference to the sensor output data. While the printhead is pressed against the printing surface, it has been observed that the printhead position as determined based upon the sensor output (and the known geometry of the printer), may vary from the actual printhead position. That is, the further data indicative of the printhead position can be used to provide an alternative indication of the actual printhead position in certain circumstances. The variation in actual position may be caused by compliance in various system components, such as, for example a belt connecting the motor to the printhead.

The further data indicative of the printhead position may be determined empirically. The further data indicative of the printhead position may be generated based upon the sensor output.

The further data indicative of the printhead position may be generated based upon a signal indicative of the angular position of the output shaft of the motor and a predetermined offset. The further data indicative of the printhead position may be generated by applying the predetermined offset to the sensor output data (or data derived therefrom).

The printhead position may, for example, correspond to an expected contact position of the printhead and the printing surface (contact being made through the ribbon and substrate), and may be referred to a printing location.

When a predetermined condition is satisfied, the data indicative of the position of the printhead may be based upon the generated signal indicative of the angular position of the output shaft of the motor. When the predetermined condition is not satisfied, the data indicative of the position of the printhead may be based upon the further data indicative of a printhead position.

That is, the printhead position, as indicated by the sensor, may be used where appropriate. However, when the printhead position, as indicated by the sensor exceeds a predetermined value, such as, for example when the sensor data indicates that the printhead has passed the expected contact position of the printhead and the printing surface, the further data indicative of a printhead position may be used in preference to the sensor data.

The printhead may be rotatable about a pivot and wherein the stepper motor is arranged to cause rotation of the printhead about the pivot to vary the position of the printhead relative to the printing surface.

The printer may further comprise a printhead assembly. The printhead assembly may comprise a first arm and a second arm. The first arm may be coupled to the stepper motor, and the printhead may be disposed on the second arm. The stepper motor may be arranged to cause movement of the first arm, thereby causing rotation of the second arm about the pivot, and causing the position of the printhead relative to the printing surface to vary. The stepper motor may be coupled to the first arm via a flexible linkage. The linkage may be a printhead rotation belt.

The printhead rotation belt may pass around a roller driven by the output shaft of the stepper motor such that rotation of the output shaft of the stepper motor causes movement of the printhead rotation belt, movement of the printhead rotation belt causing the rotation of the printhead about the pivot.

The printhead drive mechanism may be further configured to transporting the printhead along a track extending generally parallel to the printing surface.

The printhead drive mechanism may comprise a printhead drive belt operably connected to the printhead and a printhead carriage motor for controlling movement of the printhead drive belt; wherein movement of the printhead drive belt causes the printhead to be transported along the track extending generally parallel to the printing surface. The printhead may be mounted to a printhead carriage, the printhead carriage being configured to be the transported along the track extending generally parallel to the printing surface.

The printhead drive belt may pass around a roller driven by the printhead carriage motor such that rotation of an output shaft of the printhead carriage motor causes movement of the printhead drive belt, movement of the printhead drive belt causing the printhead to be transported along the track extending generally parallel to the printing surface.

The printhead carriage motor may be a position controlled motor. The printhead carriage motor may be a stepper motor. The printhead carriage motor may be controlled in a speed controlled manner.

The data indicative of the position of the printhead may be further based upon a signal indicative of the angular position of the output shaft of the printhead carriage motor.

The method may comprise controlling the two tape drive motors to control transport of ribbon between the first and second ribbon spools, said control being based upon data indicative of a position of the printhead.

The method may comprise, during a ribbon transport operation, controlling a first one of the tape drive motors to rotate at a first predetermined angular velocity to cause an amount of the ribbon to be paid out and a second one of the tape drive motors to rotate at a second predetermined angular velocity to cause an amount of the tape to be taken up. At least one of the first and second predetermined angular velocities may be modified during said ribbon transport operation based upon the data indicative of a position of the printhead.

In this way, the velocities of one or both of the tape drive motors can be adjusted to accommodate any deflection of the ribbon by the printhead. This provides for improved tension control and ribbon positioning. Any adjustment may be applied preferentially to one of the motors. For example, in an embodiment, an adjustment may be applied to the motor associated with the supply spool, so as to minimise any effect of the adjustment on the tension between the take up spool and the printhead, where the peel angle is critical to printing quality.

The first and second predetermined angular velocities may be further determined based upon data indicative of the diameters of the first and second ribbon spools respectively The method may comprise controlling the tape drive motors to cause a length of tape to be added to or subtracted from a tape extending between the spools, the length of tape being calculated based upon the data indicative of the first and second lengths.

A length of tape may be added when the printhead is displaced towards the printing surface. A length of tape may be subtracted when the printhead is displaced away from the printing surface. The length of tape added may equal the length of tape subtracted.

The length of tape may be added to or subtracted from the tape extending between the spools in order to maintain tension in the tape between predetermined limits. Whereas it is possible to measure and adjust for tension errors between printing cycles (e.g. when no printing is occurring), it may be beneficial to also adjust for path length changes during ongoing printing operations.

Moreover, where tension changes are caused by printhead movement, such movements will generally be reversed before a single printing cycle has completed. Thus, ribbon tension may be incorrect for a majority of a printing cycle (possibly resulting in inaccurate tape positioning, or printing image tracking), but correct (or at least less incorrect) when tension is measured between printing cycles. By adjusting for ribbon path length disturbances caused by the printhead during a printing cycle, it is therefore possible to improve the overall ribbon control, and therefore printer operation.

The method may comprise performing a printing cycle. Performing a printing cycle may comprise controlling the tape drive to perform a ribbon movement in which ribbon is transported between first and second ribbon spools along a ribbon path, and displacing the printhead relative to the printing surface. Performing a printing cycle may further comprise generating data indicative of a change in the length of the ribbon path based upon data indicative of the position of the printhead during said displacing. Performing a printing cycle may further comprise modifying a control signal for at least one of the tape drive motors to cause the amount of ribbon between the first and second ribbon spools to be adjusted by an amount based upon the data indicative of a change in the length of the ribbon path.

The change in the length of the ribbon path may be the difference between the first and second lengths.

The method may further comprise displacing the printhead towards the printing surface. The method may further comprise generating data indicative of a first change in the length of the ribbon path based upon data indicative of the position of the printhead during said displacing of the printhead towards the printing surface. The method may further comprise applying a first adjustment to the amount of ribbon between the first and second ribbon spools by energising at least one of the tape drive motors to cause the amount of ribbon between the first and second ribbon spools to be adjusted by a first amount based upon the data indicative of the first change in the length of the ribbon path.

The method may further comprise displacing the printhead away from the printing surface. The method may further comprise, generating data indicative of a second change in the length of the ribbon path based upon data indicative of the position of the printhead during said displacing of the printhead away from the printing surface. The method may further comprise applying a second adjustment to the amount of ribbon between the first and second ribbon spools by energising the tape drive motors to cause the amount of ribbon between the first and second ribbon spools to be adjusted by a second amount based upon the data indicative of the second change in the length of the ribbon path.

The method may further comprise, when the printhead is pressed against the printing surface, controlling the printhead to be energised to transfer ink from the ribbon to the substrate.

The method may further comprise moving ribbon past the printhead in a printing direction when the printhead is pressed against the printing surface. Each of the first and second adjustments may be applied during said movement of the ribbon.

According to a second aspect of the invention, there is provided a transfer printer configured to transfer ink from a printer ribbon to a substrate which is transported along a predetermined substrate path adjacent to the printer. The printer comprises a tape drive comprising two tape drive motors, two tape spool supports on which said spools of ribbon may be mounted, each spool being drivable by a respective one of said motors. The printer further comprises a printhead being displaceable towards and away from the predetermined substrate path and being arranged to, during printing, contact one side of the ribbon to press an opposite side of the ribbon into contact with a substrate on the predetermined substrate path, and a printing surface. The printer further comprises a controller configured to control the tape drive to transport ribbon between the first and second ribbon spools. The controller is further configured to control the tape drive to perform a ribbon movement in which ribbon is transported between first and second ribbon spools along a ribbon path, the ribbon path having a first length during a first part of said ribbon movement, and a second length during a second part of said ribbon movement, a transition from the first length to the second length being caused by a displacement of the printhead with respect to the printing surface; wherein control of at least one of the tape drive motors is based upon the first and second lengths.

Features described in the context of the first aspect of the invention may be combined with the second aspect of the invention.

According to a third aspect of the invention there is provided a method of controlling a motor in a tape drive to cause movement of a tape. The method comprises:

- generating a control signal for the motor to cause said motor to rotate to cause a tape movement, the control signal being generated based upon a target tape movement and a predetermined characteristic of the motor;
- receiving first data indicative of an updated target tape movement at a first plurality of times during said movement;
- receiving second data indicative of the generated control signal at a second plurality of times during said movement;
- determining a relationship between the first data and second data; and
- generating a further control signal for the motor to cause a further tape movement based upon said determined relationship.

By receiving updated first data during the tape movement relating to the target tape movement, it is possible to correct for discrepancies between the intended movement and the actual movement of the motor. Such corrections may be particularly useful where the motor is a stepper motor, and where the control signals applied to the motor are necessarily quantised. That is, control signals applied to the stepper motor cause the motor to advance by a single step (or sub-step). The rate at which the steps are applied is controlled to attempt to achieve a target speed. However, where the target speed changes more quickly than the rate at which the motor can follow (e.g. either because the acceleration rate is too high, or because the motor is mid-way through a step when the target speed changes), small discrepancies can occur. These discrepancies may gradually accumulate, and can lead to tape tension or tape positioning errors. Thus, by comparing the target movement (which may change rapidly during use) with the control signal generated to control the motor, it is possible to identify errors (e.g. quantisation errors) and to apply a suitable correction factor.

Determining a relationship between the first data and the second data may comprise generating data indicative of a difference between the first and second data, and comparing the generated difference to a predetermined threshold.

The method may further comprise comparing the generated difference to a further predetermined threshold. Generating the further control signal for the motor to cause a further tape movement based upon said determined relationship may comprise generating a modified control signal for the motor to reduce the difference between the first data (e.g. the intended of desired actual movement) and the second data (e.g. the movement demanded by previously applied control signals).

Generating said further control signal for controlling the motor based upon said determined relationship may comprise if said determined relationship satisfies a predetermined criterion generating a first control signal; and if said determined relationship does not satisfy the predetermined criterion generating a second control signal.

For example, if the difference is above the predetermined threshold a speed scaling factor may be applied. If the difference is above the further predetermined threshold a further speed scaling factor may be applied.

Said predetermined criterion may be data indicative of a difference between the first and second data exceeding a threshold. The threshold may be a predetermined threshold.

The first control signal may cause said motor to rotate at a first angular motor speed during the further tape movement. The second control signal may cause said motor to rotate at a second angular motor speed during the further tape movement.

The first angular motor speed may be increased or decreased with respect to the actual angular motor speed during the tape movement. The second motor angular speed may be substantially equal to the actual angular motor speed during the tape movement.

Said first control signal may be based upon said target tape movement, said predetermined characteristic of the motor, and a speed scaling factor. Said second control signal may be based upon said target tape movement, and said predetermined characteristic of the motor.

Determining the relationship between the first data and the second data may comprise generating data indicative of a cumulative difference between said first data and said second data. Said cumulative difference may be a linear amount of tape.

Generating said control signal for the motor to cause the motor to rotate to cause a tape movement may comprise generating a plurality of pulses, each pulse being configured to cause the motor to rotate by a predetermined angular amount.

A time at which each one of the plurality of pulses is generated may be determined based upon a target motor speed.

The predetermined characteristic of the motor may comprise data indicative of a permitted further control signal for the motor.

The permitted further control signal for the motor may comprise a control signal to cause the motor to rotate at a permitted angular speed. The permitted angular speed may comprise a permitted angular velocity.

The predetermined characteristic of the motor may comprise data indicative of a plurality of permitted further control signals for the motor, each one of the permitted further control signals being configured to cause the motor to rotate at a respective permitted angular speed. The predetermined characteristic of the motor may comprise data indicative of a plurality of motor step durations, each step duration corresponding to a respective angular speed.

Generating said further control signal for the motor may comprise receiving data indicative of said updated target tape movement, obtaining data indicative of a permitted further control signal for the motor, based upon said data indicative of said updated target tape movement and data indicative of said control signal, and generating said control signal based upon said permitted further control signal for the motor.

The data indicative of a permitted further control signal for the motor may comprise an acceleration table for the motor. By referring to an acceleration table, the controller can obtain data indicative of a permitted further control signal, which data may indicate a permissible next motor step rate based upon the data indicative of said updated target tape movement (e.g. a target speed) and data indicative of said control signal (e.g. a current motor speed).

The predetermined characteristic of the motor may be based upon data indicative of a diameter of a spool of tape mounted upon a spool driven by the motor.

The acceleration table may be based upon data indicative of a diameter of a spool of tape mounted upon a spool driven by the motor. In this way, a permitted linear acceleration may be converted into a permitted angular acceleration for a motor driving a spool having a particular diameter.

The first control signal may be generated by applying a predetermined speed scaling factor to data indicative of the control signal during the tape movement. The data indicative of the control signal may be indicative of the motor speed during the tape movement. The scaling factor may thus cause the motor to have a different (i.e. scaled) speed during the further tape movement.

Generating said further control signal for controlling the motor based upon said determined relationship may further comprise, if said determined relationship satisfies a second predetermined criterion, the generating a third control signal.

The third control signal may cause said motor to rotate at a third angular motor speed during the further tape movement. The third angular motor speed may be increased or decreased with respect to the actual angular motor speed during the tape movement and the first angular motor speed.

The third control signal may be generated by applying a second predetermined speed scaling factor to data indicative of the actual angular motor speed during the tape movement or the first angular motor speed.

Said first data may comprise a plurality of first data items, each first data item being indicative of a target linear tape movement. Said second data may comprise a plurality of second data items, each second data item being indicative of a distance moved by the motor. Said relationship may be based upon said plurality of first data items and said plurality of second data items.

In this way, the first and second data can be updated during tape movement to reflect changing target and/or controlled motor speeds. The relationship may be updated accordingly, so as to monitor and allow action to be taken in response to the updated first and second data.

The first plurality of times may be different from the second plurality of times. The first data may be generated or updated at a different rate than the second data.

The method may further comprise receiving further first and second data items during said further tape movement, and generating a second further control signal for controlling the motor during a second further tape movement based upon said further first and second data items.

In this way, control signals for the motor can be regularly updated to reflect changes in target speed and actual (or controlled) speed. This allows changes in target speed to be responded to, and/or deviations in actual speed from the target speed (for example deviations due to motor limitations) to be accommodated. The target speed may, for example, be generated based upon a reference speed. The reference speed may, for example, be the speed of a substrate upon which printing is carried out. The target speed may be proportional to the reference speed.

Said generating the second further control signal for controlling the motor during the second further tape movement based upon said further first and second data may comprise determining a further relationship between the further first data and the further second data; and generating the second further control signal based upon said further determined relationship.

Tape may be transported between first and second tape spools along a tape path, the tape path having a first length during said tape movement. Said relationship may be further based upon data indicative of a change in the length of the tape path.

Said speed scaling factor may be generated based upon said data indicative of a change in the length of the tape path. In this way, the speed scaling factor can be modified to ensure that an appropriate response can be made by the tape drive.

Said predetermined threshold may be modified based upon said data indicative of a change in the length of the tape path. In this way, the speed switching thresholds can be modified to ensure that an appropriate response can be made by the tape drive.

Generating said control signal for the motor to cause said tape movement may be intended to cause the tape to move a predetermined distance. That is, said tape movement may comprise a predetermined distance of tape movement.

Generating said control signal for the motor to cause said tape movement and generating said further control signal for the motor to cause said further tape movement may together be intended to cause the tape to move said predetermined distance. That is, the further control signal (and the corresponding further tape movement) may not cause the tape to move any further than the control signal (and the corresponding tape movement). Rather, the further control signal may cause the speed of movement of the tape to be modified, while the total distance moved remains unchanged.

The tape drive may be a tape drive of a transfer printer. Said tape may be an inked ribbon, and the transfer printer may comprise a printhead for selectively transferring ink from the ribbon to a substrate which is transported along a predetermined path adjacent to the printer. The printhead may be displaceable towards and away from the predetermined substrate path.

The relationship may be further based upon data indicative of a position of a printhead.

The relationship may thus be based upon data indicative of an actual linear tape distance moved during the tape movement and data indicative of a printhead movement. The printhead movement may be an expected printhead movement.

In this way, the tape drive can be controlled so as to accommodate disturbances to the ribbon by the printhead during movement of the ribbon between the spools. Such control of the tape drive allows for ribbon to be more accurately positioned during ribbon transport operations, and for ribbon tension to be maintained more closely to an optimum level during ribbon transport operations (rather than just being regulated at periodic intervals). In particular, by generating the relationship based upon data indicative of the position of the printhead in addition to the data indicative of the actual angular motor speed during the predetermined tape movement, it is possible to compensate for deviations from the expected tape movement caused by both speed errors and disturbances caused by the printhead movement.

Data indicative of the printhead position may be introduced before, during and/or after printhead movements, allowing ribbon control to anticipate and/or respond quickly to any change in ribbon path length caused as a result of the printhead movement.

Said threshold may be generated based upon data indicative of a position of a printhead. Said predetermined speed scaling factor may be generated based upon data indicative of a position of a printhead. Said data indicative of a position of a printhead may comprise data indicative of a printhead movement. Said data indicative of a printhead movement may comprise data indicative of an expected printhead movement. Said data indicative of a printhead movement may comprise data indicative of a magnitude of printhead movement, and/or data indicative of a duration of printhead movement, and/or data indicative of a direction of printhead movement.

In this way, it is possible to adjust the response of the motor control algorithm based upon printhead movement (e.g. expected printhead movement) so as to optimise the speed response.

Said relationship data indicative of a position of a printhead may comprise data indicative of a change in the length of the tape path and/or may be used to generate data indicative of a change in the length of the tape path.

The first data indicative of an updated target tape movement may comprise data indicative of a movement of said substrate along said predetermined path adjacent to the printer.

According to a fourth aspect of the invention there is provided a tape drive for transporting tape between first and second tape spools along a tape path, the tape drive comprising two tape drive motors, two tape spool supports on which said spools of tape may be mounted, wherein each spool is drivable by a respective one of said motors, and a controller. The controller is arranged to generate a control signal for at least one of the tape drive motors to cause the motor to rotate to cause a tape movement, the control signal being generated based upon a target tape movement and a predetermined characteristic of the motor. The controller is further arranged to receive first data indicative of an updated target tape movement at a first plurality of times during said movement, receive second data indicative of the generated control signal at a second plurality of times during said movement, determine a relationship between the first data and second data, and generate a further control signal for the motor to cause a further tape movement based upon said determined relationship.

There is also provided a transfer printer configured to transfer ink from a printer ribbon to a substrate which is transported along a predetermined substrate path adjacent to the printer. The printer comprises a tape drive according to the fourth aspect of the invention, the tape being an inked ribbon. The printer further comprises a printhead being displaceable towards and away from the predetermined substrate path and being arranged to, during printing, contact one side of the ribbon to press an opposite side of the ribbon into contact with a substrate on the predetermined substrate path, and a printing surface.

The transfer printer may further comprise a monitor arranged to generate an output indicative of movement of the printhead relative to the printing surface, the controller being arranged to generate data indicative of a position of the printhead based upon said output and further data indicative of a printhead position.

Features described above in the context of the first or second aspects of the invention may be combined with the third or fourth aspects of the invention, and vice versa.

A further aspect of the invention provides a transfer printer controller comprising circuitry arranged to control a transfer printer to carry out a method according to one of the first or third aspects of the invention. The circuitry may comprise a memory storing processor readable instructions and a processor configured to read and execute instructions stored in said memory, the instructions being arranged to carry out features of the methods described above.

According to a fifth aspect of the invention, there is provided a transfer printer configured to transfer ink from a printer ribbon to a substrate which is transported along a predetermined substrate path adjacent to the printer. The transfer printer comprises a tape drive for transporting ribbon between first and second ribbon spools along a ribbon path, the tape drive comprising two tape drive motors, two tape spool supports on which said spools of ribbon may be mounted, each spool being drivable by a respective one of said motors, a printhead being displaceable towards and away from the predetermined substrate path and being arranged to, during printing, contact one side of the ribbon to press an opposite side of the ribbon into contact with a substrate on the predetermined substrate path, and a printing surface, a monitor arranged to generate an output indicative of movement of the printhead relative to the printing surface; and a controller arranged to generate data indicative of a position of the printhead based upon said output and further data indicative of a printhead position.

The controller may be further configured to control at least one of the tape drive motors to control transport of ribbon between the first and second ribbon spools, said control being based upon data indicative of a position of the printhead.

Said movement may comprise movement between a retracted position spaced apart from the printing surface and an extended position in which the printhead presses against the printing surface based upon said output.

When the printhead is in contact with the printing surface and pressing against the printing surface (e.g. with the printing force), data indicative of an expected contact position may be used to generate data indicative of the actual printhead position in preference to the sensor output data. While the printhead is pressed against the printing surface, it has been observed that the printhead position as determined based upon the sensor output (and the known geometry of the printer), may vary from the actual printhead position. That is, the data indicative of the printhead position can be used to provide an alternative indication of the actual printhead position in certain circumstances. The variation in actual position may be caused by compliance in various system components, such as, for example a belt connecting the motor to the printhead.

The transfer printer may be a thermal transfer printer, and the printhead may be a thermal printhead.

According to a sixth aspect of the invention, there is provided a method of operating a transfer printer according to the fifth aspect of the invention.

Methods described above can be implemented in any convenient form. As such aspects of the invention also provide computer programs comprising computer readable instructions which can be executed by a processor associated with a tape drive, and/or a transfer printer so as to cause a tape drive and/or a printhead of the transfer printer to be controlled in the manner described above. Such computer programs can be stored on appropriate carrier media which may be tangible carrier media (e.g. disks) or intangible carrier media (e.g. communications signals). Aspects may also be implemented using suitable apparatus which may take the form of programmable computers running computer programs arranged to implement the invention.

Any feature described in the context of one aspect of the invention can be applied to other aspects of the invention.

Embodiments of the invention will now be described, by way of example, with reference to the accompanying drawings, in which.

Figure 1:
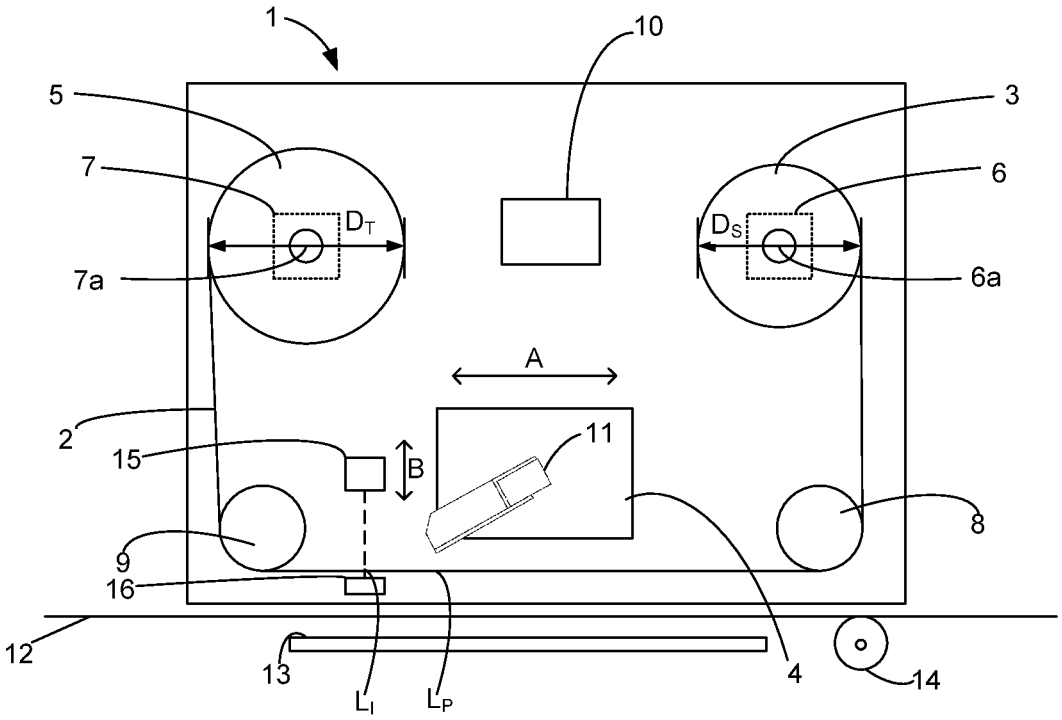
FIG. 1 is a schematic illustration of a printer in accordance with the present invention.
Figure 7A:
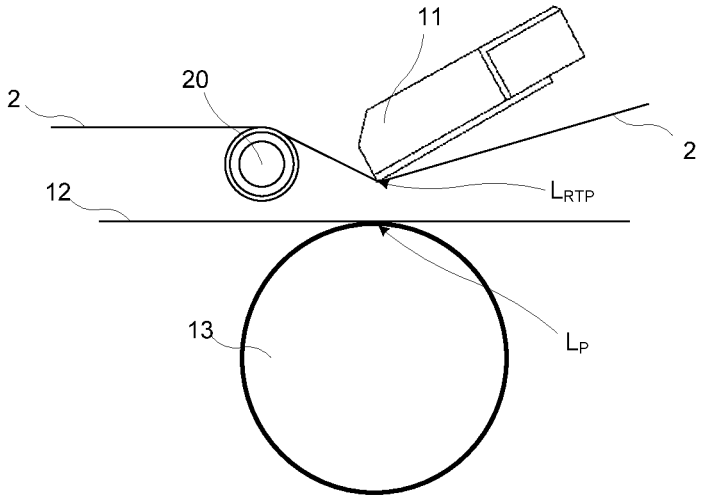
Figure 7B:
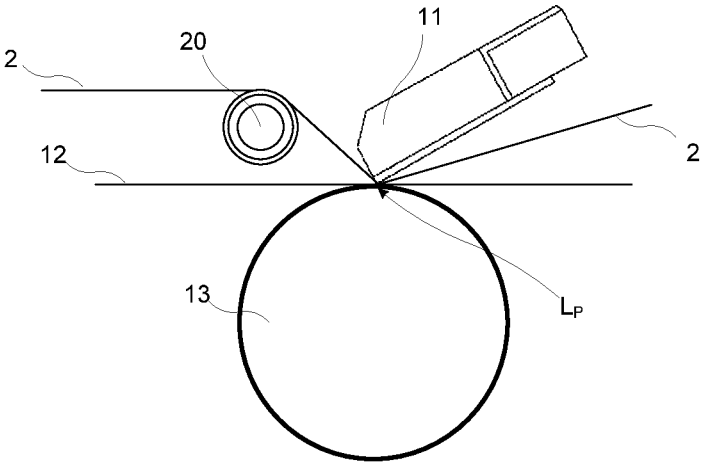
Figure 7C:
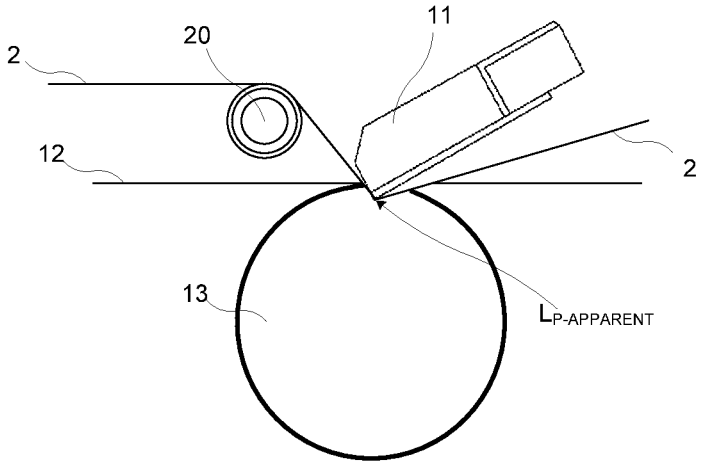
Figure 8:
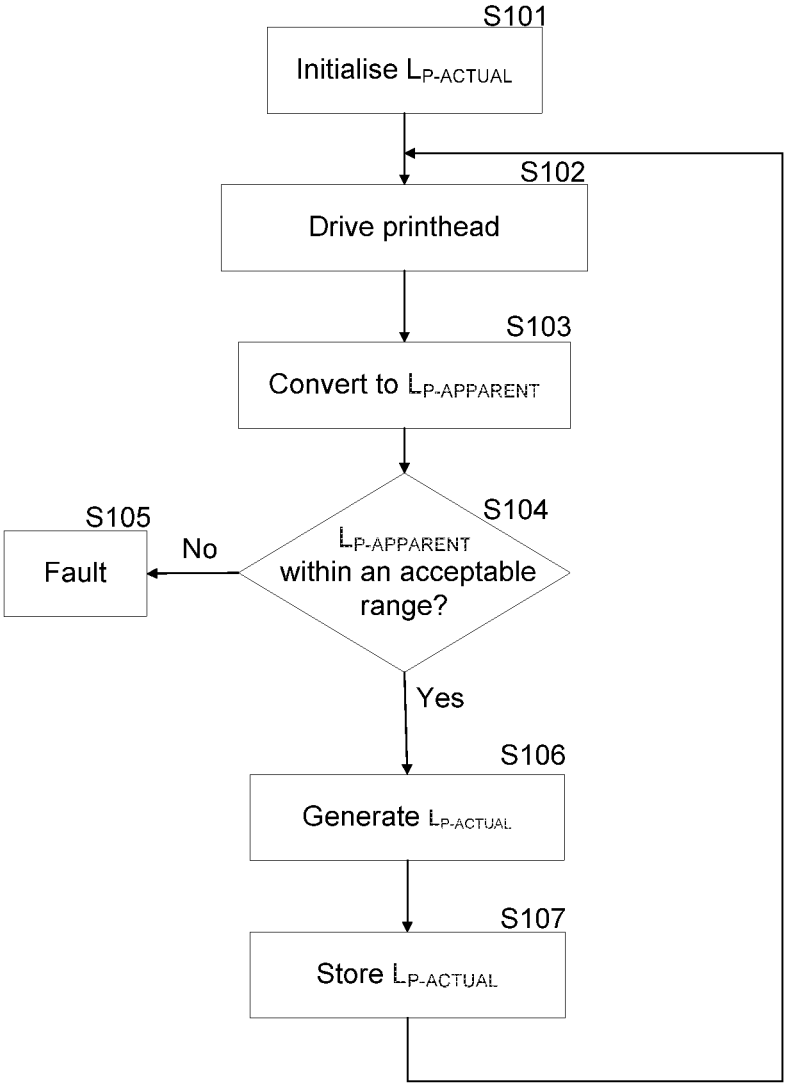
Figure 9:
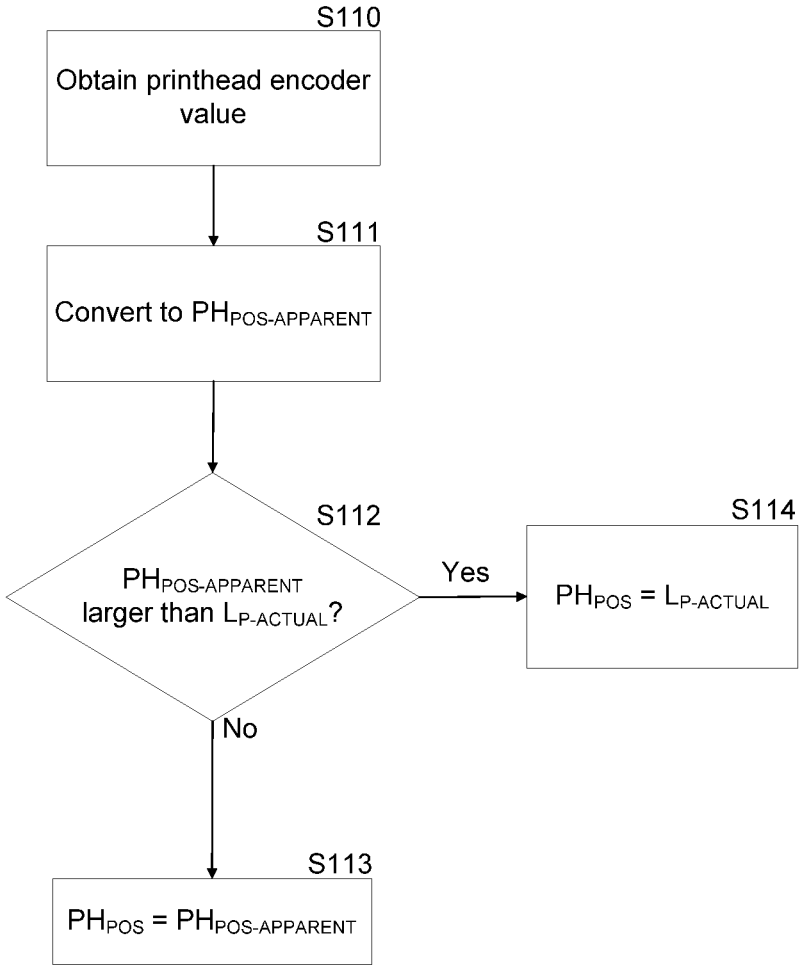

FIGS. 7*a* to 7*c* are schematic illustrations of part of the printer of FIG. 1 in various configurations;

FIG. 8 is a schematic illustration of processing performed by a controller of the printer of FIG. 1; and FIG. 9 is a schematic illustration of processing performed by a controller of the printer of FIG. 1.

Referring to FIG. 1, there is illustrated a thermal transfer printer 1 in which ink carrying ribbon 2 is provided on a ribbon supply spool 3, passes a printhead assembly 4 and is taken up by a ribbon take-up spool 5. The ribbon supply spool 3 is driven by a stepper motor 6 while the ribbon take-up spool is driven by a stepper motor 7. In the illustrated embodiment the ribbon supply spool 3 is mounted on an output shaft 6*a* of its stepper motor 6 while the ribbon take-up spool 5 is mounted on an output shaft 7*a* of its stepper motor 7. Generally (but not necessarily) the spools 3, 5 are mounted on a cassette which can be readily mounted on the printer 1. The stepper motors 6, 7 may be arranged so as to operate in push-pull mode whereby the stepper motor 6 rotates the ribbon supply spool 3 to pay out ribbon while the stepper motor 7 rotates the ribbon take-up spool 5 so as to take up ribbon. In such an arrangement, tension in the ribbon may be determined by control of the motors. Such an arrangement for transferring tape between spools of a thermal transfer printer is described in our earlier U.S. Pat. No. 7,150,572, the contents of which are incorporated herein by reference.

During ribbon movement, ribbon paid out by the ribbon supply spool 3 passes a guide roller 8 before passing the printhead assembly 4 and a further guide roller 9 before being taken up by the ribbon take up spool 5. The motors 6, 7 are controlled by a controller 10. An encoder may be provided to generate a signal indicative of the position of the output shaft of one or both of the motors 6, 7. In an embodiment, an encoder 35 is provided to monitor the rotation of the take-up spool motor 7.

The printhead assembly 4 comprises a printhead 11 which presses the ribbon 2, and a substrate 12 against a printing surface 13 to effect printing. The location at which the ribbon 2 is pressed against the printing surface 13 by the printhead assembly 4 defines a printing location $L_P$. The printhead 11 is a thermal transfer printhead comprising a plurality of printing elements, each arranged to remove a pixel of ink from the ribbon 2 and to deposit the removed pixel of ink on the substrate 12.

The printhead assembly 4 is moveable in a direction generally parallel to the direction of travel of the ribbon 2 and the substrate 12 past the printhead assembly 4, as shown by an arrow A. Thus, the printing location L varies in accordance with the movement of the printhead assembly 4 in the direction A. Further, at least a portion of the printhead assembly 4 is moveable towards and away from the substrate 12, so as to cause the ribbon 2 (when passing the printhead 11) to move into and out of contact with the substrate 12, as shown by arrow B.

An encoder 14 may be provided which generates data indicative of the speed of movement of the substrate 12 at the printing location $L_P$. The printer 1 further comprises a camera 15 and a light source 16 arranged on opposing sides of the ribbon path. The camera 15 and the light source 16 are each rigidly mounted to the base plate 24 of the printer 1. Thus the camera 15 and the light source 16 do not move with respect to the base plate 24 or other fixed components of the printer 1.

Figure 2:
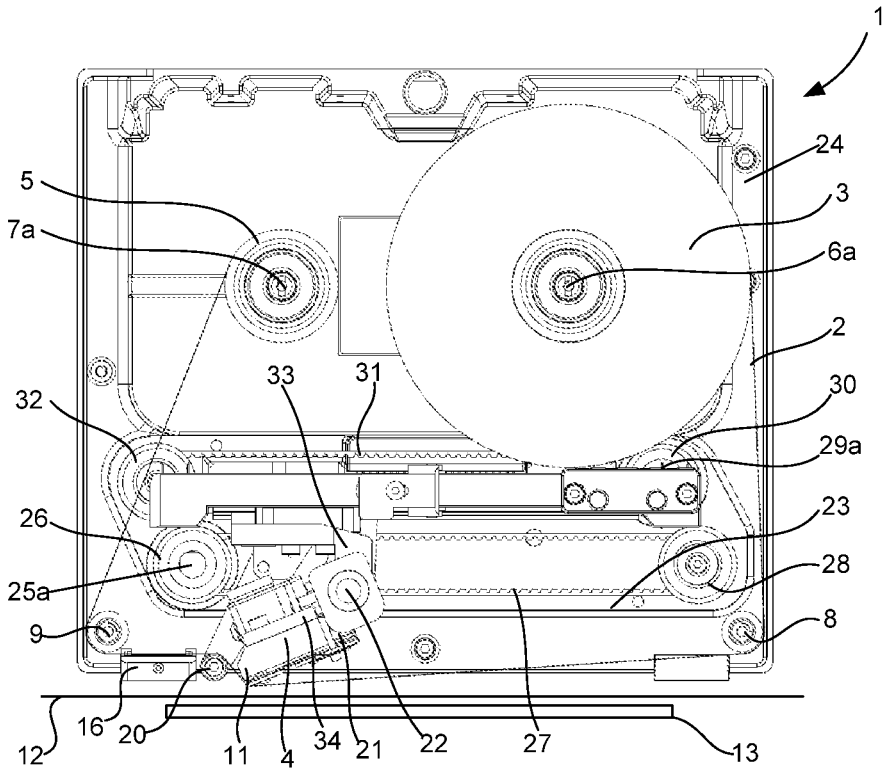
FIG. 2 is an illustration showing the printer of FIG. 1 in further detail.
Figure 3:
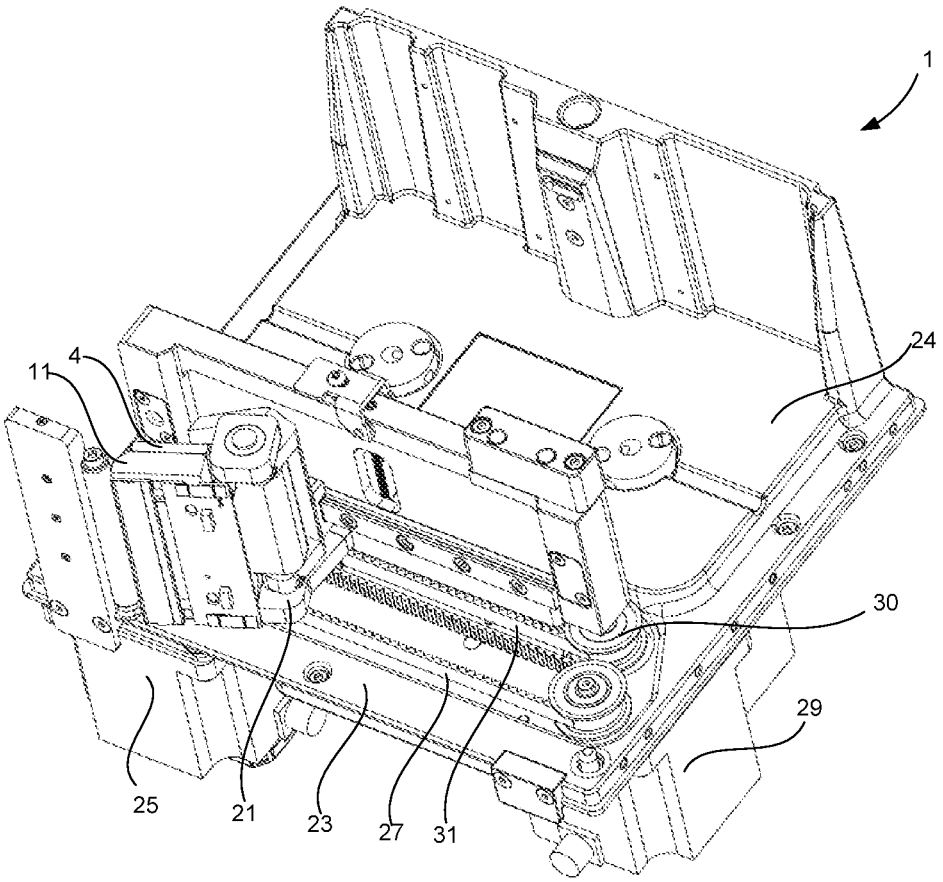
FIG. 3 is a perspective illustration showing the printer of FIG. 1 in further detail.

Referring now to FIGS. 2 and 3, the printer 1 is described in more detail. The printhead assembly 4 further comprises a guide roller 20, around which the ribbon 2 passes between the roller 9, and the printhead 11. The printhead assembly 4 is pivotally mounted to a printhead carriage 21 for rotation about a pivot 22 thereby allowing the printhead 11 to be moved towards or away from the printing surface 13. The printhead carriage 21 is displaceable along a linear track 23, which is fixed in position relative to a base plate 24 of the printer 1.

The position of the printhead carriage 21 in the direction of ribbon movement (and hence position of the printhead assembly 4) is controlled by a carriage motor 25 (see FIG. 3). The carriage motor 25 is located behind the base plate 24 and drives a pulley wheel 26 that is mounted on an output shaft 25*a* of the carriage motor 25. The pulley wheel 26 in turn drives a printhead drive belt 27 extending around a further pulley wheel 28. The printhead carriage 21 is secured to the printhead drive belt 27.

Thus rotation of the pulley wheel 26 in the clockwise direction drives printhead carriage 21 and hence the printhead assembly 4 to the left in FIG. 2 whereas rotation of the pulley wheel 26 in the counter-clockwise direction in FIG. 2 drives the printhead assembly 4 to the right in FIG. 2.

The movement of the printhead 11 towards and away from the printing surface 13 (and hence the pressure of the printhead against the ribbon 2, the substrate 12, and the printing surface 13) is controlled by a motor 29. The motor 29 is also located behind the base plate 24 (see FIG. 3) and drives a pulley wheel 30 that is mounted on an output shaft 29*a* of the motor 29. Movement of the printhead assembly 4 is controlled by appropriate control of the motors 25, 29 by the controller 10.

Figure 4:
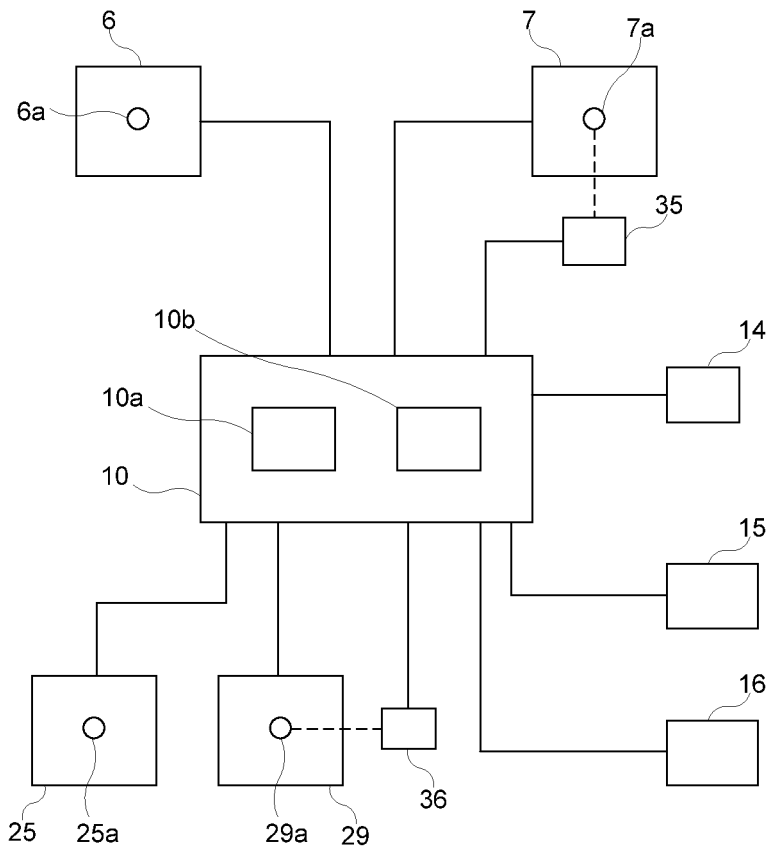
FIG. 4 is a schematic illustration of a controller arranged to control components of the printer of FIG. 1.

FIG. 4 is a schematic illustration of components involved in the control of the printer 1, including ribbon movement, printhead movements, and also image capture by the camera 15. The controller 10 comprises a processor 10*a* and a memory 10*b*. The processor 10*a* reads instructions from the memory 10*b*. The processor 10*a* also stores data in and retrieves data from the memory 10*b*. The motors 6, 7, 25, 29 are controlled by control signals generated by the controller 10. The controller 10 receives signals from the encoder 35, which signals are indicative of rotational movement of the motor 7. The controller also receives signals from the encoder 14, which signals are indicative of linear movement of the substrate 12 past the printer 1. The controller 10 also receives capture data from the camera 15 and controls the light source 16.

The motor 29 may be a stepper motor, and may be controlled in a closed loop manner by virtue of an encoder 36 which is associated with the motor shaft 29*a*. The encoder 36 may provide an output indicative of the angular position of the output shaft 29*a* of the motor 29. Such an output may be used to enable precise control of the motor 29, for example by controlling the stator field of the motor to have a predetermined angular relationship with respect to the motor shaft 29*a*.

The pulley wheel 30 in turn drives a printhead rotation belt 31 extending around a further pulley wheel 32. The printhead assembly 4 comprises a first arm 33, and a second arm 34, which are arranged to pivot about the pivot 22. The first arm 33 is connected to the printhead rotation belt 31, such that when the printhead rotation belt 31 moves the first arm 33 is also caused to move. The printhead assembly 4 is attached to the second arm 34. Assuming that the pivot 22 remains stationary (i.e. that the printhead carriage 21 does not move), it will be appreciated that movement of the printhead rotation belt 31, causes movement of the first arm 33, and a corresponding movement of the second arm 34 about the pivot 22, and hence the printhead assembly 4 (and printhead 11). Thus, rotation of the pulley wheel 30 in the clockwise direction drives the first arm 33 in to the left in FIG. 2, causing the second arm 34 to move in a generally downward direction, and the printhead assembly 4 to move towards the printing surface 13. On the other hand, rotation of the pulley wheel 30 in the counter-clockwise direction in FIG. 2 causes the printhead assembly 4 to move away from the printing surface 13.

The belts 27, 31 may be considered to be a form of flexible linkage. However, the term flexible linkage is not intended to imply that the belts behave elastically. That is, the belts 27, 31 are relatively inelastic in a direction generally parallel to the direction of travel of the ribbon 2 and the substrate 12 past the printhead assembly 4 (i.e. the direction which extends between the pulley wheel 30 and the further pulley wheel 32). It will be appreciated, of course, that the belts 27, 31 will flex in a direction perpendicular to the direction of travel of the ribbon 2 and the substrate 12 past the printhead assembly 4, so as to allow the belts 27, 31 to move around the pulleys 26, 28, 30, 32. Further, the printhead rotation belt 31 will flex in a direction perpendicular to the direction of travel of the ribbon 2 and the substrate 12 past the printhead assembly 4, so as to allow for the arc of movement of the first 33 arm about the pivot 22.

However, in general, it will be understood that the relative inelasticity ensures that any rotation of the pulley wheel 30 caused by the motor 29 is substantially transmitted to, and causes movement of, the first arm 33, and hence the printhead 11. The belts 27, 31 may, for example, be polyurethane timing belts with steel reinforcement. For example, the belts 27, 31 may be AT3 GEN III Synchroflex Timing Belts manufactured by BRECOflex CO., L.L.C., New Jersey, United States.

The arc of movement of the printhead 11 with respect to the pivot 22 is determined by the location of the printhead 11 relative to the pivot 22. The extent of movement of the printhead 11 is determined by the relative lengths of the first and second arms 33, 34, and the distance moved by the printhead rotation belt 31. Thus, by controlling the motor 29 to cause the motor shaft 29*a* (and hence pulley wheel 30) to move through a predetermined angular distance, the printhead 11 can be moved by a corresponding predetermined distance towards or away from the printing surface 13.

It will further be appreciated that a force applied to the first arm 33 by the printhead rotation belt 31 will be transmitted to the second arm 34 and the printhead 11. Thus, if movement of the printhead 11 is opposed by it coming into contact with a surface (such as, for example, the printing surface 13), then the force exerted by the printhead 11 on the printing surface 13 will be determined by the force exerted on the first arm 33 by the printhead rotation belt 31—albeit with adjustment for the geometry of the first and second arms 33, 34. Further, the force exerted on the first arm 33 by the printhead rotation belt 31 is in turn determined by the torque applied to the printhead rotation belt 31 by the motor 29 (via pulley wheel 30).

Thus, by controlling the motor 29 to output a predetermined torque, a corresponding predetermined force (and corresponding pressure) can be established between the printhead 11 and the printing surface 13. That is, the motor 29 can be controlled to move the printhead 11 towards and away from the printing surface 13, and thus to determine the pressure which the printhead applies to the printing surface 13. The control of the applied pressure is important as it is a factor which affects the quality of printing. Of course, in some embodiments, the motor 29 may also be controlled in a conventional way (e.g. an open-loop position-controlled way).

It is also noted that the position of the printhead 11 with respect to the printing surface 13 is also affected by the motor 25. That is, given the relationship between the motor 25 and the printhead assembly 4 (i.e. the coupling of the motor 25, via the belt 27, to the printhead carriage 21), movement of the motor 25 also has an impact on the position of the printhead relative to the printing surface 13.

The motor 25 may also be a stepper motor, and may be controlled in a conventional (i.e. open-loop) manner. Of course, the motors 25, 29 may be other forms of motor (e.g. DC servo motors) which can be controlled in a suitable manner to control the position of the printhead 11 and printhead assembly 4.

In a printing operation, ink carried on the ribbon 2 is transferred to the substrate 12 which is to be printed on. To effect the transfer of ink, the print head 11 is brought into contact with the ribbon 2. The ribbon 2 is also brought into contact with the substrate 12. The printhead 11 is caused to move towards the ribbon 2 by movement of the print head assembly 4, under control of the controller 10. The print head 11 comprises printing elements arranged in a one-dimensional linear array, which, when heated, whilst in contact with the ribbon 2, cause ink to be transferred from the ribbon 2 and onto the substrate 12. Ink will be transferred from regions of the ribbon 2 which correspond to (i.e. are aligned with) printing elements which are heated. The array of printing elements can be used to effect printing of an image on to the substrate 12 by selectively heating printing elements which correspond to regions of the image which require ink to be transferred, and not heating printing elements which require no ink to be transferred.

There are generally two modes in which the printer of FIGS. 1 to 3 can be used, which are sometimes referred to as a "continuous" mode and an "intermittent" mode. In both modes of operation, the apparatus performs a regularly repeated series of printing cycles, each cycle including a printing phase during which ink is transferred to the substrate 12, and a further non-printing phase during which the printer is prepared for the printing phase of the next cycle.

In continuous printing, during the printing phase the print head 11 is brought into contact with the ribbon 2, the other side of which is in contact with the substrate 12 onto which an image is to be printed. The print head 11 is held stationary during this process—the term "stationary" is used in the context of continuous printing to indicate that although the print head will be moved into and out of contact with the ribbon, it will not move relative to the ribbon path in the direction in which ribbon is advanced along that path. Both the substrate 12 and ribbon 2 are transported past the print head, generally but not necessarily at the same speed.

Generally only relatively small lengths of the substrate 12 which is transported past the printhead 11 are to be printed upon and therefore to avoid gross wastage of ribbon it is necessary to reverse the direction of travel of the ribbon between printing cycles. Thus in a typical printing process in which the substrate is traveling at a constant velocity, the print head is extended into contact with the ribbon only when the print head 11 is adjacent regions of the substrate 12 to be printed. Immediately before extension of the print head 11, the ribbon 2 must be accelerated up to for example the speed of travel of the substrate 12. The ribbon speed is then generally maintained at a speed which is based upon the speed of the substrate (e.g. equal to, or proportional to the speed of the substrate 12) during the printing phase and, after the printing phase has been completed, the ribbon 2 must be decelerated and then driven in the reverse direction so that the used region of the ribbon is on the upstream side of the print head 11.

As the next region of the substrate to be printed approaches, the ribbon 2 is then accelerated back up to the normal printing speed and the ribbon 2 is positioned so that an unused portion of the ribbon 2 close to the previously used region of the ribbon is located between the print head 11 and the substrate 12 when the print head 11 is advanced to the printing location $L_P$. It is therefore desirable that the supply spool motor 6 and the take-up spool motor 7 can be controlled to accurately locate the ribbon so as to avoid a printing operation being conducted when a previously used portion of the ribbon is interposed between the print head 11 and the substrate 12.

In intermittent printing, a substrate is advanced past the printhead 11 in a stepwise manner such that during the printing phase of each cycle the substrate 12 and generally but not necessarily the ribbon 2 are stationary. Relative movement between the substrate 12, the ribbon 2 and the printhead 11 are achieved by displacing the printhead 11 relative to the substrate and ribbon. Between the printing phases of successive cycles, the substrate 12 is advanced so as to present the next region to be printed beneath the print head and the ribbon 2 is advanced so that an unused section of ribbon is located between the printhead 11 and the substrate 12. Once again accurate transport of the ribbon 2 is necessary to ensure that unused ribbon is always located between the substrate 12 and printhead 11 at a time that the printhead 11 is advanced to conduct a printing operation. It will be appreciated that where the intermittent mode is used, the printhead assembly 4 is caused to move along the linear track 23 so as to allow its displacement along the ribbon path.

In each of the aforementioned modes, during the transfer of tape from the supply spool 3 to the take up spool 5, both the supply spool motor 6 and the take-up spool motor 7 are energised in the same rotational direction. That is, the supply spool motor 6 is energised to turn the supply spool 3 to pay out an amount of tape while the take-up spool motor 7 is energised to turn the take-up spool 5 to take-up an amount of tape.

The motors 6, 7 can therefore be said to operate in "push-pull" mode, with both motors being operated in a position (or speed) controlled manner. Where tension in the tape is to be maintained, it is important that the linear quantity of tape paid out by the supply spool is essentially equal to the linear quantity of tape taken up by the take-up spool. Additionally, as noted above it is desirable to transport a predetermined linear distance of tape between spools. This requires knowledge of the diameters of the spools given that the drive is applied to the spools and the linear length of tape transferred by a given rotational movement of the spools will vary in dependence upon the spool diameters. This knowledge can be obtained and updated in a variety of ways, several of which is are described in our earlier U.S. Pat. No. 7,150,572.

As described above, during continuous printing operations, the ribbon 2 is controlled based upon the speed of the substrate 12 moving past the printhead 11. For example, data indicative of the speed of movement of the substrate 12 may be obtained from the encoder 14. Such data may be referred to as a substrate speed. During continuous printing, the supply and take up spool 3, 5 are caused to rotate by the motors 6, 7 so as to cause the ribbon 2 at the printing location $L_P$ to move at a linear speed which is substantially equal, or at least based upon, the substrate speed. For example, as described in our earlier patent application WO2016/067052 the ribbon speed may be controlled so as to be a percentage (e.g. 96%) of the substrate speed. The speed of the ribbon 2 at the printhead 11 during printing in continuous mode may be referred to as a ribbon speed.

During ribbon movements, each of the motors 6, 7 are controlled by the controller so as to move at an angular speed which causes ribbon to be advance at a predetermined linear speed past the printhead 11. Where the motors 6, 7 are stepper motors, the control of the motors to move at a predetermined angular speed results in the each of the motors being controlled to advance at a predetermined step rate.

It will be understood that, as is well known in the field of motor control, the stepper motors 6,7 may be controlled to advance in increments which correspond to full steps at the native resolution of the motor (e.g. 1.8 degrees per step, or 200 steps per full revolution), or sub-steps (e.g. half-, quarter-, or micro-steps). By controlling the motors to advance in micro-step increments, it is possible to control the angular position of the output shaft of the motor far more accurately than in full-step operation, thereby allowing more refined control of the ribbon movement. However, even where micro-stepping is used, the motors 6, 7 are each controlled by reference to a set of discrete output angular positions. In the following description, where reference is made to motors being advanced by 'steps', or 'steps' being applied to a motor, it will be understood that the motor may be advanced by an amount that corresponds to a full-step, a half-step, a quarter-step or a micro-step (e.g. an eighth-step), depending on the configuration.

In order to achieve relatively smooth rotation of the motors, and the rapid accelerations and decelerations that are required in a printer tape drive, the motors are controlled by specifying times at which steps should be applied. The times at which these steps are applied may be determined based upon acceleration tables which are stored in a memory associated with the controller 10. The acceleration tables may contain data indicative of a set of motor speeds, and/or rates (which correspond to angular speeds) at which steps should be applied to the motors. In an embodiment the acceleration tables contain data indicative of a delay between motor steps for each of a set of motor speeds.

Moreover, the acceleration tables define transitions between step rates (which correspond to speeds) which can be achieved while operating within the operational limits of the motors. That is, a stepper motor may stall if accelerations or decelerations are attempted to be applied which require torques to be applied which are greater than the motor capabilities (whilst taking into account the inertia of spools of ribbon driven by the motors). As such, the acceleration tables contain data which is indicative of the maximum safe acceleration rates which can be applied to a motor.

The acceleration tables may be based upon data indicative of the maximum angular acceleration rate for each motor, and may, for example, be re-calculated for each printing cycle so as to take into account current spool diameters values. That is, at the time of use (i.e. during a printing cycle) each acceleration table may already have been re-calculated based upon current spool diameter values so as to contain step rate data for a particular motor in a particular winding condition operating at various linear ribbon speeds. Thus, no adjustment for spool diameter is needed at the time at which the acceleration tables are accessed. Of course, it will be appreciated that the adjustment for spool diameter could be made at run-time if preferred. Alternatively, the acceleration tables could be updated at a different rate, for example, after each time a predetermined length (e.g. 750 mm) of ribbon has been transferred between the spools.

Further, the acceleration tables for each motor in a printer (taking into account the current diameter of spools of tape mounted on those motors) may be generated so as to generally correspond to one another. For example, rather than an acceleration table for a motor driving a first spool having small diameter (and therefore small linear distance per step) being generated which allows a significantly different acceleration profile than a corresponding acceleration table for a motor driving a second spool of the same printer which has a large diameter (and therefore larger linear distance per step), the acceleration tables for the two motors may be generated such that the maximum linear acceleration rates are generally consistent for the two motors.

For example, a global maximum linear acceleration value (e.g. 25 $m/s^2$) may be used to generate the acceleration tables for both motors at all spool diameters. Such a maximum linear acceleration value may be selected based upon a rate at which a motor driving a spool having a maximum allowable spool diameter can be safely accelerated and decelerated without causing the motor to stall.

It will, however, be appreciated that even if acceleration tables generated for both of the motors 6, 7 provide a common maximum linear acceleration, for any particular actual motor speed, and a desired new ribbon speed, the two motors may have to respond to the speed demand differently. That is, given the different step sizes (in terms of linear distance of tape moved per step), the acceleration table for each motor will contain different speed entries, with different allowable speed steps based upon the current spool diameters.

In use, where the desired ribbon speed changes, the updated desired ribbon speed is then converted into motor step rates by looking up the most suitable (and achievable) step rate in the relevant acceleration table. In particular, a modified step rate is determined with reference to the acceleration tables, the modified step rate being a step rate which is as close to the desired step rate as can be achieved without exceeding an allowable acceleration. Steps are then applied to each of the motors at the modified (i.e. achievable) step rates. Where the closest achievable step rate to a desired step rate (e.g. as determined based upon the desired ribbon speed) is below the desired step rate, the step rate will be updated again at the next refresh cycle (i.e. after a next step has been applied), so as to allow the motor to be accelerated towards the desired speed over two (or more) steps.

For example, in a configuration in which a supply spool diameter is 50 mm, and a take up spool diameter is 100 mm, a maximum permitted acceleration rate is 25 $m/s^2$ and in which the motors 6, 7 are each controlled in a $1/8^{th}$ step manner, the acceleration table for each motor may include entries as shown in Table 1.

TABLE 1

Extract of exemplary acceleration tables

| Supply Spool (Spool diameter: 50 mm) | | Take-up Spool (Spool diameter: 100 mm) | |
|---|---|---|---|
| Index | Speed | Index | Speed |
| 1 | 70.06 | 1 | 99.08 |
| 2 | 99.08 | 2 | 140.12 |
| 3 | 121.35 | 3 | 171.62 |
| 4 | 140.12 | 4 | 198.17 |
| 5 | 156.66 | 5 | 221.56 |
| 6 | 171.62 | 6 | 242.70 |
| 7 | 185.37 | 7 | 262.15 |
| 8 | 198.17 | 8 | 280.25 |
| 9 | 210.19 | 9 | 297.25 |
| 10 | 221.56 | 10 | 313.33 |
| 11 | 232.37 | 11 | 328.62 |
| 12 | 242.70 | 12 | 343.23 |
| . . . | . . . | . . . | . . . |

Each entry in each of the tables is representative of a linear ribbon speed. The speeds are calculated as the linear speed that is reached at the circumference of the spool by moving the motor a single step, with the spool being accelerated at the maximum permissible acceleration during that step, starting either a stationary position (entry 1), or the previous speed entry (entries 2 and onwards). For each current spool speed, and a desired spool speed, the tables can be consulted to determine an allowable next speed. It is not permitted to make more than a single speed jump in the table in a single step, so if a desired speed change exceeds the permitted change, the desired speed change is applied over two (or more) steps.

Assuming that both spools are in motion with a current ribbon speed of 200 mm/s, the supply spool motor, driving a supply spool with a diameter of 50 mm, can be driven at a maximum speed of 210.19 mm/s for the next step (entry 9). This is on the basis that the closest table entry below the current speed is 198.17 mm/s (entry 8).

It is noted that where a deceleration is required, the closest table entry above the current speed will be used as the starting point, so as to ensure that the maximum acceleration rate is not exceeded.

The take up spool motor, driving a take-up spool with a diameter of 100 mm, and currently rotating at 200 mm/s also a closest table entry below the current speed of 198.17 mm/s (entry 4) can be driven at a maximum next speed of 221.56 mm/s (entry 5).

Thus, in this example, if a new desired ribbon speed is 220 mm/s, the supply spool will not be able to achieve that speed in the next step, whereas the take up spool motor can achieve (and exceed) that speed.

The next step applied to the motors will cause each motor to accelerate, but will cause the supply spool motor to accelerate to 210.19 mm/s (entry 9), whereas the take up spool motor will be caused to accelerate to the desired speed of 220 mm/s. However, the subsequent step for the supply spool will allow the speed to increase from 210.19 mm/s (entry 9) to up to 221.56 mm/s (entry 10). As such, a speed of 220 mm/s will be selected and, after two steps, the supply spool motor will also be at the desired speed.

It is noted that the two steps required to be applied to the supply spool motor to reach the desired speed will be completed at around the same time as the single step required by the take-up spool motor has been completed. This is because the supply spool diameter is 50 mm, as compared to a take-up spool diameter of 100 mm, which results in a 2:1 step ratio for the same linear distance moved.

Of course, it will be appreciated that the times at which steps are applied, and the step duration, will vary between the motors in dependence upon the spool diameters. Thus, during ongoing motor operations, the current speed, the next desired speed and permitted maximum and minimum speeds are continually changing for each motor, at different rates.

In general terms, for each step performed, the controller may identify the step rate above and below the current rate in the relevant table. These rates are used as upper and lower limits for the next step. If a subsequent speed target is above the upper limit, the upper limit is used, and if a subsequent speed target is below the lower limit, the lower limit is used. If the subsequent speed target within the allowable range, the target speed is used. If the current speed corresponds to an entry in the relevant acceleration table, the allowable speed range may be a full step above or below the current speed.

In this way, during ribbon transport operations, i.e. when attempting to drive the motors 6, 7 in accordance with a desired motion profile, it will be understood that the controller 10 will make frequent reference to the acceleration tables, and will continually update the rate at which steps are applied to the motors 6, 7 to attempt to ensure that the ribbon is moved as closely as possible to a desired speed as can be achieved within the limitations of the printer.

In some embodiments the ribbon may be required to be advanced at a ribbon speed which is based upon a substrate speed (e.g. at a speed which is proportional to the substrate speed). In such an arrangement, the substrate speed may be referred to as a master speed. Changes in substrate speed (for example, which may be monitored by the encoder 14) may result in an updated desired ribbon speed being determined. The updated desired ribbon speed is then converted into motor step rates by looking up the most suitable (and achievable) step rate in the relevant acceleration table as described above.

Figure 5:
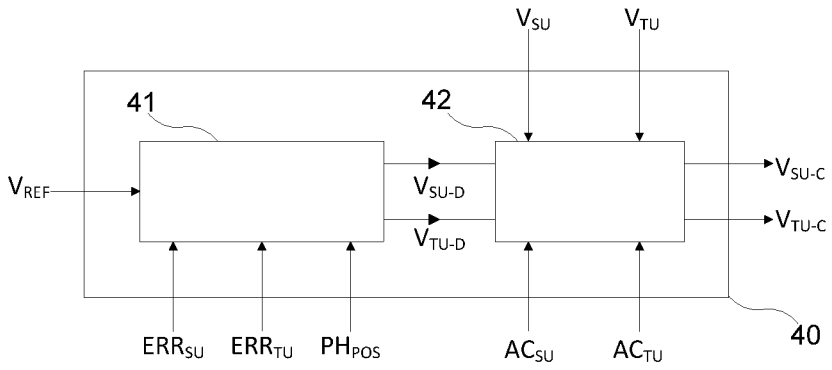
FIG. 5 is a schematic illustration of processing performed by a controller of the printer of FIG. 1.

The use of acceleration tables in this way is now described with reference to FIG. 5. The processing described may, for example, be performed by the controller 10. A ribbon feed controller 40 receives, as an input data indicative of a reference speed $V_{REF}$. The reference speed $V_{REF}$ may be based on the speed of the substrate 12, as received from the encoder 14. The input $V_{REF}$ is passed to a ribbon feed correction block 41, where the reference speed is adjusted to generate a desired supply spool speed $V_{SU\text{-}D}$ and a desired take-up spool speed $V_{TU\text{-}D}$. For example, as described briefly above, the spool speeds may be calculated to be a percentage (e.g. 96%) of the substrate speed. Of course, the desired ribbon speed may be a different percentage (e.g. 100%) of the substrate speed.

Alternatively, the desired ribbon speed may be generated based upon a different reference speed, such as, for example, an internally generated reference speed (i.e. not the encoder data). In some embodiments, an internally generated reference speed is used during some ribbon movements, while an external reference (e.g. the substrate speed) is used during other ribbon movement. For example, in an embodiment an internally generated reference is used during deceleration, and ribbon rewind operations, with the substrate speed being used during the acceleration and printing phases of continuous printing operations. In some embodiments, the internally generated reference speed may also be used during ribbon acceleration. The reference speed $V_{REF}$ upon which the ribbon speed is based may be referred to as the "master" speed.

Further, in some embodiments the ribbon movement may be controlled based upon substrate movement in different ways. For example, it is been realised that, in some instances, an image printed by the printer on the substrate having a first length may result in a negative image having a different length being formed on the ribbon. For example, a printed image of 70 mm in length may result in a negative image of 69 mm being formed. Thus the ribbon may be controlled during and between printing operations such that the portion of unused ribbon between adjacent negative images is minimised.

For example, when attempting to place adjacent 70 mm long images at an offset of 70.5 mm (thereby allowing a 0.5 mm gap), an actual gap of 1.5 mm may be observed between adjacent negative images. Thus, the ribbon movement may be adjusted such that images are attempted to be placed at an offset of 69.5 mm, thereby allowing an actual gap of 0.5 mm, and reducing the wastage of ribbon by 1 mm for every 70 mm of printed image.

Of course, different scaling factors may be used as appropriate. Any such adjustment of scaling factor may be made empirically, for example by monitoring the actual dimensions of negative ribbon images. Without wishing to be bound by theory, it is believed that the mismatch between negative image length and printing image length may be a result of the 'ironing' of ribbon between the printhead and the printing surface during printing.

It will be understood that image scaling performed in order to allow comparison between the expected printed image and captured images (as described in more detail below) may also apply a scaling factor to compensate for this effect.

The desired spool speeds $V_{TU\text{-}D}$ $V_{SU\text{-}D}$ are passed to a spool speed block 42, which also receives as inputs the current take-up spool speed $V_{TU}$ and the current supply spool speed $V_{SU}$. The spool speed block 42 obtains, from a memory location, appropriate acceleration tables $AC_{TU}$, $AC_{SU}$ for the take-up and supply spools (which have previously been generated based upon knowledge of the current spool diameters).

Based upon the acceleration tables $AC_{TU}$, $AC_{SU}$, the current speeds $V_{TU}$, $V_{SU}$, and the desired spool speeds $V_{TU-D}$ $V_{SU-D}$, the spool speed block 42 generates a commanded supply spool speed $V_{SU-C}$ and a commanded take-up spool speed $V_{TU-C}$ as described above in more detail.

It will, of course, be appreciated that during ongoing operations the desired speed may change rapidly, and in a way which is beyond the capabilities of the motors 6, 7. In such circumstances the ribbon speed (as controlled by the spool speeds) may be adjusted in response to changes in substrate speed. However, there may be a lag between an updated substrate speed being detected, and an updated ribbon speed being achieved. Thus, while the actual ribbon speed is not equal to the desired spool speeds speed, the distance moved by the ribbon will not match the desired distance (which may, for example, be derived from the distance moved by the substrate).

Moreover, even where any requested changes are well within the capabilities of the motors 6, 7, where the ribbon speed is adjusted in response to changes in substrate speed, there may be a lag between an updated substrate speed being detected, and an updated ribbon speed being achieved.

Further, as described above, one motor may be able respond more quickly to a desired speed change than the other motor, resulting in discrepancies in the amount of ribbon fed by the two motors.

Any discrepancy between the actual speed of a motor and the desired speed will result in the amount of ribbon fed by that motor deviating from the expected (or desired) amount. Thus, during each tape transport operation, the controller monitors the actual cumulative distance fed by each of the motors (for example by recording the number of steps applied to each motor). This monitored cumulative distance may be used to improve the control of the motors. For example, where motion is controlled with reference to substrate movement (e.g. by use of the encoder 14), the cumulative distance moved by the substrate 12 may be monitored and regarded as the "master" distance. Cumulative distances moved by each of the spools may also be monitored and compared to the "master" distance. If either of the monitored spool distances deviates by more than a predetermined amount from the master distance, an appropriate correction can be made.

Further, as the desired speed changes during operation, the different step rates of the two motors (i.e. due to there being different spool sizes) result in the same speed change having a different effect on different motors. For example, a first motor having a high step rate (i.e. a small spool diameter) may "see" a temporary speed fluctuation which is not "seen" by a second motor having a lower step rate (i.e. a large spool diameter, and thus a lower speed refresh rate.

More generally, the different step rates (due to different spool diameters) result in there being different effective sampling rates of the desired speed for each of the motors, and therefore different speed errors, resulting in different accumulated distance errors. Where a desired speed fluctuates rapidly (e.g. due to a noisy substrate encoder signal), this can have a significant cumulative effect where one motor can track the noise, whereas another cannot.

For example during a substrate movement of 100 mm, the take-up spool 5 may be recorded as taking up 100.1 mm of ribbon, and the supply spool 3 may be recorded as paying out 99.7 mm of ribbon. In this case, the total ribbon paid out is less than that taken up by 0.4 mm, which will result in there being an increase in ribbon tension.

Figure 6:
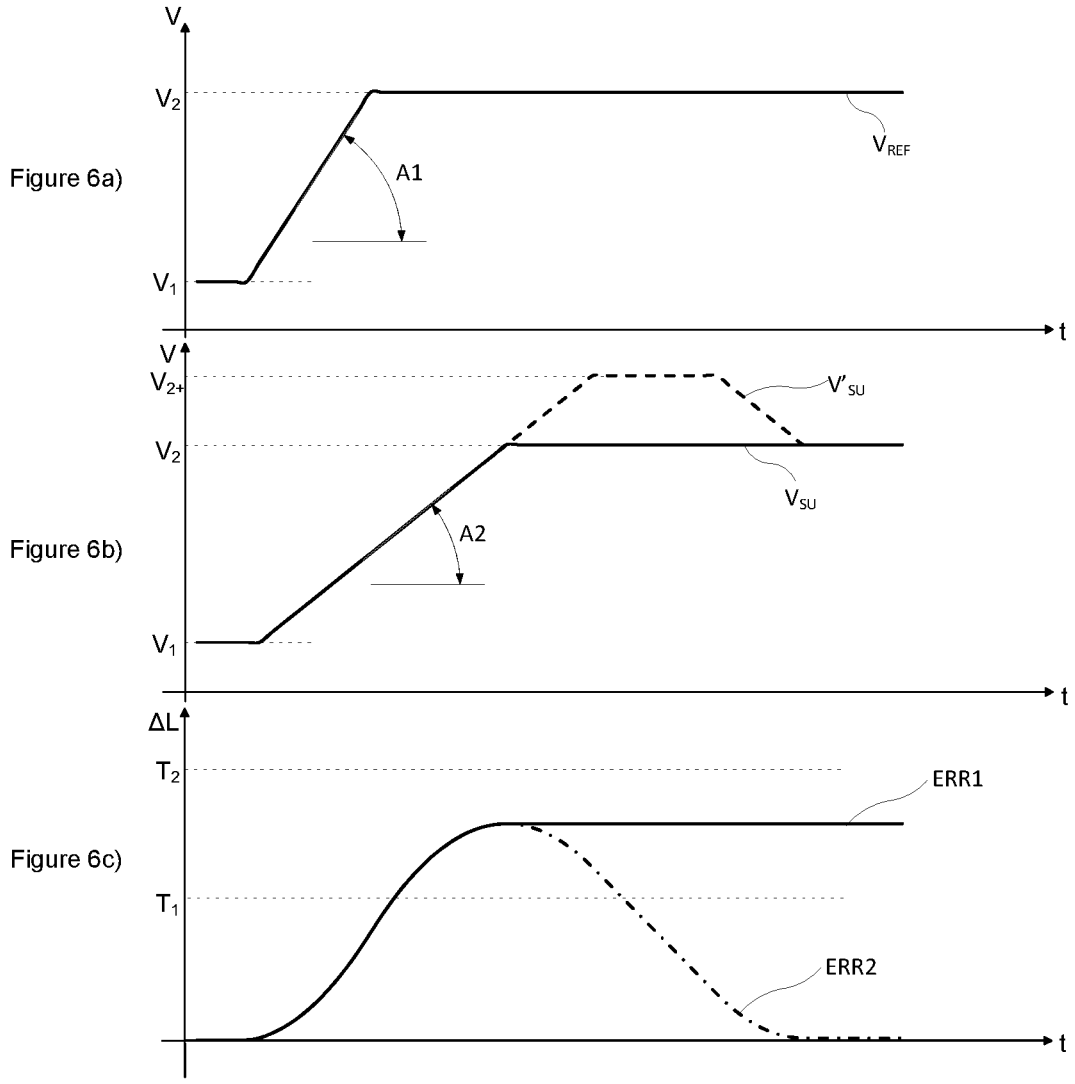
FIG. 6 is a schematic illustration of velocity and position data relating to a substrate and spool of ribbon of the printer of FIG. 1.

FIG. 6*a* illustrates an exemplary motion profile in which the speed of the substrate $V_{REF}$ is shown accelerating from a first speed V1 to a second speed V2 at a rate of acceleration A1. The vertical axis represents speed, while the horizontal axis represents time. The linear speed $V_{SU}$ of the supply spool motor 3 is shown in FIG. 6*b*, in which the vertical axis represents speed, while the horizontal axis represents time. Shortly after the substrate speed begins to increase, the supply spool speed $V_{SU}$ also begins to increase. However, the supply spool motor 3 cannot accelerate at the rate A1, and thus the rate of increase A2 in the supply spool speed $V_{SU}$ is less than that of the substrate speed $V_{REF}$.

FIG. 6*c*, in which the vertical axis represents cumulative position error, and the horizontal axis represents time, shows the cumulative position error ERR1 of the supply spool motor 6 during the acceleration of the supply spool 3 and substrate 12.

In order to mitigate any negative effects associated with these errors in feed distances, corrections can be applied to the motor control signals during ongoing ribbon movements (but during the same print cycle) in order to correct the feed errors.

For example, the controller 10 may be arranged to monitor the cumulative distances fed and compare to the master distance, and, if the differences exceeds a predetermined threshold, apply a correction. The correction may, for example, take the form of an increase or decrease in the target speed of the spool concerned. Thus, rather than correcting the distance instantaneously (which could potentially cause an abrupt change in ribbon tension and/or ribbon positioning), a speed scaling factor is applied to the relevant motor. Moreover, abrupt speed changes may not be within the physical capabilities of the motors.

For example, a first distance error threshold T1 of ±0.1 mm may be provided. If the cumulative error exceeds this threshold T1, a first speed scaling factor S1 of 0.5% (positive or negative as required) may be applied. A similar process may be performed independently for each of the spools 3, 5.

Further, if required, additional thresholds and corrections may be applied. For example a second threshold T2 of ±0.33 mm may be provided, and if this threshold is exceeded, a second speed scaling factor S2 of 1.8% applied, and so on. As greater errors are identified, corrections of greater magnitude may be required.

The threshold (or thresholds) may be selected so as to maintain tension within predetermined limits. That is, a particular threshold may correspond to a tension deviation from a nominal ribbon tension that is known to provide reliable printing performance and tape drive operation. Moreover, the threshold (or thresholds) may be selected so as to allow the inevitable and transient errors in motor positioning to occur without correction. In particular, the different motor step rates (due to different spool diameters) result in there being an inevitable difference in apparent instantaneous relative motor shaft position throughout a ribbon movement operation. For example, while one motor may apply three steps, the other may apply one step for the same linear distance moved. In this situation, during the stepping process, the apparent position error between the motors will fluctuate. However, this position error will cancel itself out over several steps, assuming that the motors are moving substantially the same distance. If the threshold was set at a level which was triggered during every stepping cycle, corrections may be applied too quickly, and oscillations may occur.

Of course, while the apparent motor shaft position may change immediately after each step command is issued, in practice, the shaft position will change more gradually, and may effectively be in continuous motion, rather than moving abruptly between stationary positions.

The effect of such corrections is illustrated in FIGS. 6*b* and 6*c*. As shown in FIG. 6*c*, a first error threshold T1 is exceeded by the cumulative error ERR1 during the acceleration. In response, the speed of the supply spool is increased to reduce the cumulative error.

In addition to the profile showing the speed of the supply spool $V_{SU}$ in FIG. 6*b*, a modified speed profile $V_{SU}'$ is also shown as a dashed line. In the modified speed profile $V_{SU}'$, rather than the acceleration (at the maximum rate A2) stopping when the speed V2 is reached, the spool is accelerated (at the maximum rate A2) for longer, to a speed V2+ which is 2% greater than the speed V2. The modified cumulative error ERR2 is shown in FIG. 6*c*. Rather than remaining fixed after the acceleration has been completed (as does ERR1), the modified cumulative error ERR2 is reduced due to the effect of increasing the spool speed to V2+, until the error falls below the threshold T1. The increased spool speed V2+ is thus maintained until the error has been reduced, at which time the spool speed $V_{SU}$ is reduced to the speed of the substrate V2.

In some embodiments the scaling factors may be removed as soon as the error value falls below the relevant threshold level. In alternative embodiments, one or more additional switch-off threshold levels may be provided. For example, where a first threshold T1 is set at ±0.1 mm, a first turn-off threshold TO1 may be set at ±0.08 mm. Similarly, where a second threshold T2 is set at ±0.33 mm, a second turn-off threshold TO2 (which triggers the switch from second speed scaling factor S2 to the first speed scaling factor S1) may be set at ±0.12 mm.

The take-up spool can be controlled in a similar way. Further, the desired spool speeds can be calculated independently of the substrate speed (e.g. where the substrate speed is not provided as an input, or during intermittent printing operations).

Furthermore, in some embodiments, the spool speeds can, during part of a printing cycle, be generated based upon the substrate speed (e.g. during printing), and at other times (e.g. during ribbon acceleration, deceleration, and positioning/rewind) be generated based upon a predetermined motion profile. In some embodiments, one of the motors is controlled based upon the current speed of the other motor (which is used as the reference speed $V_{REF}$). That is, either of the supply or take-up spool motor can operate as the "master" motor, with the other motor acting as a "slave".

The control described above with reference to FIG. 6 may be performed by the ribbon feed controller 40. In particular, in order to reduce any negative consequences associated with the error in ribbon positioning and tension control, data indicative of the cumulative position errors for the supply spool $ERR_{SU}$ and the take-up spool $ERR_{TU}$, may be provided to the feed correction block 41. In this way, the accumulation of position (and associated tension) errors as a result of small speed errors, and in particular small speed errors which may each only apply for only a very short time, can be reduced.

It will be appreciated, however, that even where the linear quantity of ribbon paid out and taken up by the spools 3, 5 is accurately controlled to be equal (for example, by controlling the spool speeds as described above), any change in the ribbon path length can cause variations in ribbon tension. For example, during printing operations, the printhead 11 is caused to deflect the ribbon 2 into and out of contact with the substrate 12. The distance moved by the printhead between a retracted position (which may be referred to as a ready to print location $L_{RTP}$) and an extended position (when the printhead 11 is pressed against the printing surface, also referred to as a printing location $L_P$) may be around 2 mm, and may vary between different printer configurations and installations. As such, the ribbon path length may be caused to vary during printing operations by an amount which has a material effect of the tension in the ribbon. Moreover, the deflection of the ribbon 2 by the printhead 11 may result in the portion of ribbon 2 which is printed on at the printing location $L_P$ being different to the portion of ribbon 2 intended or expected to be printed on.

As such, and in order to further reduce any negative consequences associated with the error in ribbon positioning and tension control, data indicative of the increase (or decrease) of ribbon path length may be provided to the feed correction block 41. Such data may be referred to a printhead position data $PH_{POS}$.

Such data may be used to apply a further correction to the desired supply and take up spool speeds $V_{SU\text{-}D}$, $V_{TU\text{-}D}$. For example the desired supply and take up spool speeds $V_{SU\text{-}D}$, $V_{TU\text{-}D}$ may be scaled by a further factor such that an adjusted feed speed is determined for each spool. Alternatively, the printhead position data $PH_{POS}$ may be added to either one or both of the position errors for the supply spool $ERR_{SU}$ and the take-up spool $ERR_{TU}$. That is, the stored data indicating the cumulative error may be adjusted in anticipation of an expected printhead movement. On other words, an anticipated path length error may be injected into one or more of the error accumulators. In this way, the processing described above (e.g. using a threshold value and speed scaling factor) may be used to accommodate printhead movements.

Further, in some embodiments, one or more of the threshold values and/or speed scaling factors may be modified in order to respond quickly to an expected disturbance. For example, the speed scaling factor S2 associated with the second threshold level T2 may be increased based upon the ribbon path length error to be injected. The scaling factor adjustment may, for example, be calculated based upon the magnitude of the path length adjustment to be made, the current ribbon target speed, and the anticipated time it will take the printhead to complete the movement. Further, the T2 off level TO2 may be adjusted prevent any overshoot. For example, if the speed scaling factor is increased, the likelihood of overshoot is increased. Therefore, the threshold at which the speed scaling factor is reduced may also be increased, so as to lessen any overshoot (i.e. so that the speed scaling reverts to the first speed scaling factor S1 more quickly).

For example, where the speed scaling factor S2 is large (e.g. 50%), and the ribbon speed is also significant (e.g. 400 mm/s), when reverting from the second threshold to the first threshold, the motor may need to rapidly accelerate or decelerate when the turn off threshold TO2 is crossed. However, if this threshold TO2 is set at the level described above (e.g. 0.12 mm error) the adjustment will require a change of speed from a 50% scaled speed, to a 0.5% scaled speed. Moreover, with only 0.12 mm of error needing to be corrected at this stage, it is unlikely that a motor will be able to accelerate or decelerate quickly enough to reach the new target speed before an error has accumulated in the opposite direction. Thus, the second turn off threshold TO2 may be increased so as to provide a longer period in which the correction can be effected.

It will be understood that the speed scaler factors S1, S2 and threshold levels T1, T2 may initially be configured to respond to the gradual accumulation of errors in distance that occur during normal ribbon feeding operations. Since these errors are generally fairly small in magnitude, and occur relatively slowly, the feed correction block 41 may react with small corrections over a relatively long period of time. In particular, it is not ordinarily expected or intended that there are sudden large changes in the ribbon speed during printing, as this could affect the print quality, and lead to print sizing defects.

However, these concerns do not apply when the printhead is being withdrawn, since the printhead cannot be printing at this time. Moreover, the scaling factors used to respond to gradual error accumulations may not be large enough to correct the error introduced by the printhead movement before the ribbon feed has completed. Thus, one or more of the speed scaling factors (e.g. the second speed scaling factor S2) may be adjusted to correct the path length error that is about to be introduced in approximately the amount of time that the printhead movement is expected to take.

In some embodiments, the second threshold T2 is reduced to the extent that it is the same as the first threshold T1. In such an arrangement, the second speed scaling factor S2 is applied as soon as the first threshold T1 (and second threshold T2) is reached. This may be preferred where any path length adjustment is small (e.g. where there is a small gap between the ready to print position and the printing position). For example, if no T2 adjustment was made, an error which is just below the second threshold T2 level (e.g. 0.3 mm) may only be corrected by a small (e.g. 0.5%) speed scaling factor, and may thus take some considerable time to be corrected. However, where the second speed scaling factor S2 is adjusted based upon the required correction (e.g. the magnitude of the error $ERR_{SU}$), the second threshold may also be reduced to allow the second speed scaling factor S2 to be applied more quickly. In an embodiment, if an anticipated path length change would cause an effort between the first and second threshold T1, T2, the second threshold may be adjusted to fall between the anticipated error, and T1.

More generally, it is noted that the path length disturbances which result from step timing errors (which gradually accumulate) are different in nature to those which result from printhead movements (which apply almost instantaneously). Thus, the response to each type of path length change may be optimised for each disturbance while still using the same underlying control algorithm.

It is further noted that the speed scaling factors and thresholds may be adjusted only in the direction of the correction that is required. For example, for a printhead retraction movement (which requires ribbon to be removed from the path to avoid slack ribbon), only the second threshold and speed scaling factor for ribbon removal are adjusted. Of course, the opposite may apply during a printhead extension movements.

In some embodiments, the data indicative of the printhead position $PH_{POS}$ may be used only to the adjust control of the supply spool motor 3. Such control may be considered to reduce the likelihood of rapid tension changes being caused between the take up spool 5 and the printhead 11, which could have a detrimental effect on ribbon peel angle, and therefore print quality.

It will, of course, be appreciated that during each printing operation the printhead will be brought into contact with, and then out of contact with the printing surface. Thus, positive and negative adjustments may be made to ribbon path length (e.g. via adjustments to the position errors for the supply spool $ERR_{SU}$) during a single printing cycle.

Moreover, given the high speed at which steps may be applied to the motors 6, 7 (e.g. at stepping rates of up to several, or even several tens of, kilohertz), it is possible that printhead movements will be ongoing for more than a single step. That is, a printhead movement may span several motor steps. Indeed, in some embodiments, a printhead movement may take around 10 ms, which may, for example, span 500 tape drive motor steps.

As such, in some circumstances, the printhead position data $PH_{POS}$ may be modified across several steps, so as to provide accurate and up to date information regarding the actual ribbon path length at every point in time (rather than assuming that the printhead movement is instantaneous). In this way, any speed adjustment made by the ribbon feed correction block 41 may be distributed over several motor steps.

However, in a preferred embodiment, it is assumed that the printhead movement is instantaneous, on the basis that the maximum acceleration for the motors 6, 7 may limit the rate at which the tape drive can respond, and thus the response to the printhead position movement will effectively be distributed over several steps by the limited acceleration. In such an arrangement, the path length error is injected to the error accumulator as soon as the printhead movement begins.

If the path length error was added gradually (for example based upon detected printhead position), it is possibly that there would be a significant delay during the initial part of the printhead movement whilst the error value accumulated, thereby delaying any corrective response. If is noted, however, that if the ribbon motors provided were capable of higher acceleration rates, and thus able to respond to an error more quickly, it may be preferred to for the path length adjustment block to use the printhead position data directly (rather than anticipating the path length change).

The printhead position data $PH_{POS}$ may be generated in any convenient way. For example, the printhead position data $PH_{POS}$ may be generated with reference to the motor 29 which controls the movement of the printhead 11. In particular, the printhead position data $PH_{POS}$ may be generated by monitoring steps applied by the motor 29. Alternatively, the printhead movement data may be generated with reference to the encoder 36 associated with the motor 29. For example, it may be assumed that any movement of the motor shaft 29*a* will correspond to a movement of the printhead 11.

Further, as noted above, given the relationship between the motor 25 and the printhead assembly (i.e. the coupling of the motor 25, via the belt 27 to the printhead carriage 21), movement of the motor 25 also has an impact on the position of the printhead relative to the printing surface.

Thus, in general terms it will be understood that at any point in time, the position of the printhead 11 can be determined by reference to the motor 29, and the motor 25. That is, for a given angular position of the motor shafts 25*a*, 29*a*, there is a predictable angle of the arms 33, 34, and thus a predictable position of the printhead 11 with respect to the body of the printer 1.

However, in use, the position of the printing surface 13 with respect to the body of the printer 1 may vary. It some prior art printers, it is known for a nominal platen separation to be programmed by a user during printer configuration. However, such a process may be inherently unreliable. Moreover, even if the initial platen separation was accurate, configuration changes may occur, resulting in the nominal separation becoming inaccurate.

It is desirable, therefore, for a number of reasons to provide a more accurate indication of the gap between the printhead 11 and the printing surface 13 when the printhead 11 is in the ready to print location $L_{RTP}$ to the printer controller 10. Such data may be used as described above to adjust the control of the motors 6, 7, controlling the movement of ribbon between the spools. Alternatively, or additionally, such data may be used to allow more accurate tracking of regions of ribbon which are used for printing.

A process by which accurate estimates of platen gap and printhead position during printing operations will now be described.

It is possible to monitor the point at which the printhead makes contact with a printing surface by monitoring the power supplied to a motor driving the printhead (and thus the torque applied by that motor). However, it is been realised that there may be errors between the position of the printhead 11 as determined purely by reference to the point at which in the printhead 11 makes contact with the printing surface as indicated by the motor controlling that movement, and the actual deflection of the ribbon 2 during printing operations. For example, calculating the printing location $L_P$ on the basis of the position of motor shaft 29*a* alone can lead to an overestimate of the extension of the printhead 11. It is understood that the various belts and mechanical linkages, as well as the inherent compliance within the printing surface (e.g. a print roller) can contribute such errors.

As such, it has been realised that by applying a negative offset to the apparent printhead position, a more accurate representation of the ribbon deflection can be achieved. The offset may be empirically determined to provide robust detection of the printing location $L_P$. Moreover, the offset may vary depending upon the printing force and other configuration changes (e.g. a change in print roller).

Various positions of the printhead can be understood by reference to FIGS. 7*a* to 7*c*.

FIG. 7*a* shows schematically the printhead 11 in a ready to print location $L_{RTP}$, spaced apart from the printing surface 13 (in this case a platen roller). It can be seen that the ribbon 2 is in contact with the printhead 11, and is guided at the downstream edge of the printhead by the roller 20. However, the printhead 11 is spaced apart from the printing location $L_P$.

FIG. 7*b* shows the printhead 11 in a position where it has been moved towards the printing surface 13, and is just at the point of making contact with the printing surface 13 at the printing location $L_P$. However, in this configuration, very little force is being applied to the printing surface 13 by the printhead 11.

FIG. 7*c* shows the apparent position $PH_{POS\text{-}APPARENT}$ of the printhead 11 as indicated by the encoder 36 associated with the motor 29. It can be seen that the apparent position of the tip of the printhead 11 is beyond the surface of the printing surface 13. In fact, the actual position of the printhead 11 will be in contact with the printing surface 13 substantially at the printing location $L_P$, and making firm contact with the printing surface 13 such that there may be some deflection of the printing surface 13. However, as discussed briefly above, there may also be deflections in other components of the printer which contribute to a difference between the apparent ($PH_{POS\text{-}APPARENT}$) and actual ($PH_{POS}$) printhead positions during printing.

A process by which printhead position data $PH_{POS}$ is generated will now be described with reference to FIG. 8.

At step S101, a data item indicative of the actual printing location $L_{P\text{-}ACTUAL}$ is initialised. Processing passes to step S102 where the printhead 11 is driven towards the printing surface 13 by the motor 29. During this movement, the motor 25 is held stationary, so as to prevent any movement of the carriage 21 in a direction parallel to the printing surface 13 along the linear track 23. During this movement of the printhead the motor 29 may be controlled to deliver a maximum torque which corresponds to a predetermined printing force being exerted on the printing surface 13.

During the movement of the printhead at step S102, the encoder 36 associated with the motor 29 is monitored. Once the encoder output value $PH_{ENC}$ stops changing, indicating that an equilibrium (i.e. substantially stationary) position has been reached, with the predetermined printing force being exerted on the printing surface 13 by the printhead 11, processing passes to step S103.

It will be understood that the encoder 36 may rarely be totally stationary. As such, a low pulse rate may be detected, and considered to be indicative of an equilibrium position being reached. Moreover, a processing delay may be inserted before the encoder output is monitored at step S102, so as to allow for any system latency (e.g. a delay after a move command is generated and before the encoder value begins to change).

At step S103, the encoder value $PH_{ENC}$ when the equilibrium position is reached is stored as an apparent printing location $L_{P\text{-}APPARENT}$. The apparent printing location $L_{P\text{-}APPARENT}$ is an encoder position which indicates the apparent position of the printing location.

It will be understood that the apparent printing location (in terms of a physical position with reference to other components of the printer) may subsequently be generated with reference to the known angular position of the output shaft 25*a* of the motor (as indicated by the encoder data $PH_{ENC}/L_{P\text{-}APPARENT}$) and the known geometry of the printer (e.g. the position of the belts 27, 31, the length and alignment of the arms 33, 34 etc.). This conversion may be performed at any convenient time as required, for example, with reference to a lookup table containing known relationships between encoder values and actual printhead positions.

Processing then passes to steps S104, where the apparent printing location $L_{P\text{-}APPARENT}$ is compared to reference data so as to determine if the apparent printing location $L_{P\text{-}APPARENT}$ is within an a acceptable range (e.g. a platen separations of 0 mm to 5 mm). Of course, where the apparent printing location $L_{P\text{-}APPARENT}$ is an encoder value, data indicating an acceptable range may be provided in terms of encoder values corresponding to acceptable physical positions. If the value is not in an acceptable range, a fault is raised to the user at step S105.

Provided this apparent printing location $L_{P\text{-}APPARENT}$ is within an acceptable range, processing passes to step S106, where a predetermined offset value $PH_{OFF}$ is subtracted from the apparent printing location $L_{P\text{-}APPARENT}$. That is, an offset is applied such that the apparent printing location $L_{P\text{-}APPARENT}$ as determined by the angular position of the encoder 36 (and therefore motor shaft 29*a*) is adjusted so as to correspond to an earlier position in the movement of the printhead 11 towards the printing surface 13. The offset value $PH_{OFF}$ may be a number of encoder pulses. The resulting position may be referred to as an actual printing location $L_{P\text{-}ACTUAL}$.

It will be understood that as the printhead 11 makes contact with the printing surface 13, the printing surface 13 may be compressed. Moreover, the belts 27, 31 may flex in a direction perpendicular to the direction of travel of the ribbon 2 and the substrate 12. Such flexion will result in some rotation of the motor 29*a* not being transferred to movement of the printhead. Moreover, once contact has been made between the printhead 11 and the printing surface 13, the portion of ribbon at the printing location $L_P$ will be somewhat restricted in its movement due to the friction forces between the various surfaces.

It is been observed that by applying an empirically determined offset to the apparent printing location $L_{P\text{-}APPARENT}$ when the motor 29 stops rotating to generate the actual printing location $L_{P\text{-}ACTUAL}$ data, it is possible to obtain a more accurate indication of the actual location of the printing location $L_P$, which more accurately reflects the actual ribbon deflection during printing operations.

Once the actual printing location $L_{P\text{-}ACTUAL}$ has been determined, processing passes to step S107 where this data is stored for subsequent use.

The processing of steps S102 to S107 is repeated for each subsequent printhead movement (e.g. during printing operations) and, for each movement of the printhead into contact with the printing surface 13, the actual printing location $L_{P\text{-}ACTUAL}$ is updated. For example, rather than simply relying upon a single measurement, in use the actual printing location data $L_{P\text{-}ACTUAL}$ may be based upon an average of a plurality (e.g. ten) of previous printhead movements. In this way, any changes in printing location L during ongoing printing operations can be monitored.

During printing operations, a number of uses may be made of the actual printing location data $L_{P\text{-}ACTUAL}$. For example, the actual printing location $L_{P\text{-}ACTUAL}$ may be passed to the ribbon feed controller 40 as printhead position data $PH_{POS}$ (as described above with reference to FIG. 5) so as to allow for compensation for any change in ribbon path length as a result of printhead movement, such as, for example, printhead movement towards and away from the printing surface. The actual change path length (i.e. a distance in mm) may be generated from the printhead position data $PH_{POS}$ by reference to a lookup table stored in memory. The lookup table may include path length values for the ready to printer position $L_{RTP}$ and the actual printing location position $L_{P\text{-}ACTUAL}$ with encoder values (i.e. $PH_{POS}$ data) being used to index the lookup table. For each printhead position change, a corresponding change in path length can thus be calculated.

However, it will be understood that during movement of the printhead the printhead position will vary, and will not, therefore, be equal to the actual printing location $L_{P\text{-}ACTUAL}$ at all times.

Processing performed by the controller 10 to generate an appropriate printhead position $PH_{POS}$ to provide to the ribbon feed controller 40 is now described with reference to FIG. 9.

At step S110, current printhead encoder value $PH_{ENC}$ is obtained. Processing passes to step S111 where the value is converted to an apparent printhead position $PH_{POS\text{-}APPARENT}$. In an embodiment, the apparent printhead position $PH_{POS\text{-}APPARENT}$ is simply an encoder value. Alternatively, in other embodiments the apparent printhead position $PH_{POS\text{-}APPARENT}$ may be a physical position and may be generated with reference to a lookup table storing positional information, or by processing of the current encoder value $PH_{ENC}$ and known geometry data. However, in the described embodiment, the conversion from encoder values to actual distances is performed at a different processing step (e.g. within the ribbon feed controller 40).

It is noted that, at the point at which the encoder output value $PH_{EN}C$ stops changing, the apparent printhead position $PH_{POS\text{-}APPARENT}$ value will be equal to the apparent printing location $L_{P\text{-}APPARENT}$ value generated at step S106. However, whereas the apparent printing location $L_{P\text{-}APPARENT}$ value represents a single location, the apparent printhead position $PH_{POS\text{-}APPARENT}$ value is a continually varying quantity.

Processing then passes to step S112 where the apparent printhead position $PH_{POS\text{-}APPARENT}$ is compared with the currently stored actual printing location $L_{P\text{-}ACTUAL}$ (as generated in step S107). If the current apparent printhead position $PH_{POS\text{-}APPARENT}$ is smaller than the stored actual printing location $L_{P\text{-}ACTUAL}$ value, then the current position data item is used as the data indicative of printhead position $PH_{POS}$. That is, if the apparent printhead position $PH_{POS\text{-}APPARENT}$ indicates that the printhead 11 has not yet reached the printing location $L_P$, then processing passes to step S113 where the apparent printhead position $PH_{POS\text{-}APPARENT}$ is used in subsequent processing as the data indicative of printhead position $PH_{POS}$.

On the other hand, if the apparent printhead position $PH_{POS\text{-}APPARENT}$ is greater than the stored actual printing location $L_{P\text{-}ACTUAL}$, then processing passes to step S114 where the stored actual printing location $L_{P\text{-}ACTUAL}$ is used as the data indicative of printhead position $PH_{POS}$.

In this way, an estimate of the actual printing location $L_{P\text{-}ACTUAL}$ is obtained and maintained during ongoing printing operations. This actual printing location $L_{P\text{-}ACTUAL}$ corresponds to an encoder value indicative of a platen separation (the platen separation being a distance to be moved by the printhead between the ready to print location $L_{RTP}$ and the printing location $L_P$).

Moreover, by using an offset value, allowance is made for various system compliances that could otherwise cause a discrepancy between the apparent printing location $L_{P\text{-}APPARENT}$ and the actual printing location $L_{P\text{-}ACTUAL}$.

Further, during ongoing movements of the printhead, the lesser of the apparent printhead position $PH_{POS\text{-}APPARENT}$ and the actual printing location $L_{P\text{-}ACTUAL}$ is passed to ribbon feed controller 40 (or other function within the printer controller 10) as the indicative printhead position $PH_{POS}$. This allows the actual data to be used where the printhead is in a free space position (i.e. where it is not in contact with the printing surface 13) but uses the more robust offset and averaged printhead location data $L_{P\text{-}ACTUAL}$ when it is pressed against the printing surface 13.

In this way, accurate and robust data is provided to the various functions of the printer controller 10 as required, allowing accurate ribbon control and more accurate tracking of regions of ribbon which are used for printing.

Where references have been made to stepper motors herein, it will be appreciated that motors other than stepper motors could be used in alternative embodiments. Indeed, stepper motors are an example of a class of motors referred to position-controlled motors. A position-controlled motor is a motor controlled by a demanded output rotary position. That is, the output position may be varied on demand, or the output rotational velocity may be varied by control of the speed at which the demanded output rotary position changes. A stepper motor is an open loop position-controlled motor. That is, a stepper motor is supplied with an input signal relating to a demanded rotation position or rotational velocity and the stepper motor is driven to achieve the demanded position or velocity.

Some position-controlled motors are provided with an encoder providing a feedback signal indicative of the actual position or velocity of the motor. The feedback signal may be used to generate an error signal by comparison with the demanded output rotary position (or velocity), the error signal being used to drive the motor to minimise the error. A stepper motor provided with an encoder in this manner may form part of a closed loop position-controlled motor.

An alternative form of closed loop position-controlled motor comprises a DC motor provided with an encoder. The output from the encoder provides a feedback signal from which an error signal can be generated when the feedback signal is compared to a demanded output rotary position (or velocity), the error signal being used to drive the motor to minimise the error.

It will be appreciated from the foregoing that various position controlled motors are known and can be employed in embodiments of a printing apparatus. It will further be appreciated that in yet further embodiments conventional DC motors may be used.

While various disclosures herein describe that each of two tape spools is driven by a respective motor, it will be appreciated that in alternative embodiments tape may be transported between the spools in a different manner. For example a capstan roller located between the two spools may be used. Additionally or alternatively, the supply spool may be arranged to provide a mechanical resistance to tape movement, thereby generating tension in the tape.

In general terms, ribbon is caused to advance between the spools in a controlled manner, so as to allow a predetermined portion of ribbon to be provided at the printing location and/or the imaging location at a particular point in time (e.g. during printing and/or imaging operations. Techniques described above relating to motor control compensation based upon printhead position data may be applied tape drives comprising to a single motor, or to a single motor of a tape drive.

The terms ribbon and tape may be used interchangeably. For example, where the techniques described are applied to a transfer printer (such as a thermal transfer printer) the tape may be a ribbon. However, it will be understood that tape drive control techniques described herein may also be applied to a tape drive for transporting other forms of tape.

The controller 10 has been described in the foregoing description (particularly with reference to FIG. 4). It will be appreciated that the various functions attributed to the controller 10 can be carried out by a single controller or by separate controllers as appropriate. It will further be appreciated that each described controller function can itself be provided by a single controller device or by a plurality of controller devices.

Each controller device can take any suitable form, including ASICs, FPGAs, or microcontrollers which read and execute instructions stored in a memory to which the controller is connected.

The described and illustrated embodiments are to be considered as illustrative and not restrictive in character, it being understood that only the preferred embodiments have been shown and described and that all changes and modifications that come within the scope of the inventions as defined in the claims are desired to be protected. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A method of operating a transfer printer configured to transfer ink from a printer ribbon to a substrate which is transported along a predetermined substrate path adjacent to the printer, the printer comprising:

a tape drive comprising two tape drive motors, two tape spool supports on which said spools of ribbon may be mounted, each spool being drivable by a respective one of said motors;

a printhead being displaceable towards and away from the predetermined substrate path and being arranged to, during printing, contact one side of the ribbon to press an opposite side of the ribbon into contact with a substrate on the predetermined substrate path, and a printing surface; and a controller configured to control the tape drive to transport ribbon between the first and second ribbon spools;

the method comprising:

controlling the tape drive to perform a ribbon movement in which ribbon is transported between first and second ribbon spools along a ribbon path, the ribbon path having a first length during a first part of said ribbon movement when the printhead is separated from the printing surface, and a second length during a second part of said ribbon movement when the printhead is in contact with one side of the ribbon, a transition from the first length to the second length being caused by a displacement of the printhead towards the printing surface, wherein control of at least one of the tape drive motors is based upon data indicative of a change in the length of the ribbon path between the first and second lengths.

2. A method according to claim 1, wherein control of the at least one of the tape drive motors is based upon data indicative of a position of the printhead.

3. A method according to claim 2, wherein the at least one tape drive motor is controlled based upon data indicative of a change in the length of the ribbon path, said data indicative of a change in the length of the ribbon path being determined based upon said data indicative of the position of the printhead.

4. A method according to claim 1, wherein when the printhead is displaced so as to cause the ribbon to come into contact with the substrate, the controller is configured to control the at least one tape drive motor to increase the amount of ribbon extending between the spools.

5. A method according to claim 1 wherein, when the printhead is displaced so as to cause the ribbon to come out of contact with the substrate, the controller is configured to control the at least one tape drive motor to reduce the amount of ribbon extending between the spools.

6. A method according to claim 1, wherein the printer further comprises a printhead drive apparatus, the method comprising:

controlling the printhead drive apparatus to drive the printhead towards and away from the predetermined substrate path, and generating the data indicative of a change in the length of the ribbon path based upon a property of the printhead drive apparatus.

7. A method according to claim 6, wherein the printhead drive apparatus comprises a printhead motor.

8. A method according to claim 7, wherein the printer further comprises a sensor configured to generate a signal indicative of an angular position of the output shaft of the printhead motor.

9. A method according to claim 8, wherein the data indicative of the position of the printhead is based upon the generated signal indicative of the angular position of the output shaft of the printhead motor.

10. A method according to claim 9, wherein the data indicative of the position of the printhead is further based upon further data indicative of a printhead position.

11. A method according to claim 10, wherein when a predetermined condition is satisfied, the data indicative of the position of the printhead is based upon the generated signal indicative of the angular position of the output shaft of the motor, and when the predetermined condition is not satisfied, the data indicative of the position of the printhead is based upon the further data indicative of a printhead position.

12. A method according to claim 1, comprising, during a ribbon transport operation, controlling a first one of the tape drive motors to rotate at a first predetermined angular velocity to cause an amount of the ribbon to be paid out and a second one of the tape drive motors to rotate at a second predetermined angular velocity to cause an amount of the tape to be taken up, wherein at least one of the first and second predetermined angular velocities is modified during said ribbon transport operation based upon the data indicative of a position of the printhead.

13. A method according to claim 1, comprising controlling the tape drive motors to cause a length of tape to be added to or subtracted from a tape extending between the spools, the length of tape being calculated based upon the data indicative of the first and second lengths.

14. A method according to claim 1, wherein the method comprises performing a printing cycle, the printing cycle comprising the steps of:

controlling the tape drive to perform a ribbon movement in which ribbon is transported between first and second ribbon spools along a ribbon path;

displacing the printhead relative to the printing surface;

generating data indicative of a change in the length of the ribbon path based upon data indicative of the position of the printhead during said displacing;

modifying a control signal for at least one of the tape drive motors to cause the amount of ribbon between the first and second ribbon spools to be adjusted by an amount based upon the data indicative of a change in the length of the ribbon path.

15. A method according to claim 14, wherein the method comprises:

displacing the printhead towards the printing surface;

when the printhead is pressed against the printing surface, controlling the printhead to be energised to transfer ink from the ribbon to the substrate;

generating data indicative of a first change in the length of the ribbon path based upon data indicative of the position of the printhead during said displacing of the printhead towards the printing surface;

applying a first adjustment to the amount of ribbon between the first and second ribbon spools by energising at least one of the tape drive motors to cause the amount of ribbon between the first and second ribbon spools to be adjusted by a first amount based upon the data indicative of the first change in the length of the ribbon path;

displacing the printhead away from the printing surface;

generating data indicative of a second change in the length of the ribbon path based upon data indicative of the position of the printhead during said displacing of the printhead away from the printing surface; and applying a second adjustment to the amount of ribbon between the first and second ribbon spools by energising the tape drive motors to cause the amount of ribbon between the first and second ribbon spools to be adjusted by a second amount based upon the data indicative of the second change in the length of the ribbon path.

16. A method according to claim 15, wherein the method further comprises moving ribbon past the printhead in a printing direction when the printhead is pressed against the printing surface, wherein each of the first and second adjustments are applied during said movement of the ribbon.

17. A transfer printer configured to transfer ink from a printer ribbon to a substrate which is transported along a predetermined substrate path adjacent to the printer, the printer comprising:

a tape drive comprising two tape drive motors, two tape spool supports on which said spools of ribbon may be mounted, each spool being drivable by a respective one of said motors;

a printhead being displaceable towards and away from the predetermined substrate path and being arranged to, during printing, contact one side of the ribbon to press an opposite side of the ribbon into contact with a substrate on the predetermined substrate path, and a printing surface; and a controller configured to control the tape drive to transport ribbon between the first and second ribbon spools, the controller being further configured to:

control the tape drive to perform a ribbon movement in which ribbon is transported between first and second ribbon spools along a ribbon path, the ribbon path having a first length during a first part of said ribbon movement when the printhead is separated from the printing surface, and a second length during a second part of said ribbon movement when the printhead is in contact with one side of the ribbon, a transition from the first length to the second length being caused by a displacement of the printhead towards the printing surface; wherein control of at least one of the tape drive motors is based upon a change in the length of the ribbon path between the first and second lengths.

* * * * *